US009961440B2

(12) United States Patent
Gabai et al.

(10) Patent No.: US 9,961,440 B2
(45) Date of Patent: May 1, 2018

(54) SYSTEMS AND METHODS FOR USING ELECTROSTATIC MICROPHONE

(71) Applicant: WIZEDSP LTD., Tel-Aviv (IL)

(72) Inventors: Oz Gabai, Tel-Aviv (IL); Haim Primo, Ganey Tikva (IL)

(73) Assignee: WIZEDSP LTD., Tel-Aviv (IL)

( * ) Notice: Subject to any disclaimer, the term of this patent is extended or adjusted under 35 U.S.C. 154(b) by 0 days. days.

(21) Appl. No.: 15/107,110

(22) PCT Filed: Dec. 25, 2014

(86) PCT No.: PCT/IB2014/067325
§ 371 (c)(1),
(2) Date: Jun. 22, 2016

(87) PCT Pub. No.: WO2015/097681
PCT Pub. Date: Jul. 2, 2015

(65) Prior Publication Data

US 2016/0337751 A1 Nov. 17, 2016

Related U.S. Application Data

(60) Provisional application No. 61/920,759, filed on Dec. 25, 2013, provisional application No. 61/926,794, filed on Jan. 13, 2014.

(51) Int. Cl.

| | |
|---|---|
| ***H04R 3/00*** | (2006.01) |
| ***H04R 19/00*** | (2006.01) |
| ***H04R 19/01*** | (2006.01) |
| ***H04R 29/00*** | (2006.01) |
| ***H04R 3/06*** | (2006.01) |

(52) U.S. Cl.
CPC ..... *H04R 3/00* (2013.01); *H04R 3/06* (2013.01); *H04R 19/005* (2013.01); *H04R 19/016* (2013.01); *H04R 29/00* (2013.01)

(58) Field of Classification Search
USPC ..... 381/92, 111, 113, 114, 116, 122, 150
See application file for complete search history.

(56) References Cited

U.S. PATENT DOCUMENTS

| | | | | |
|---|---|---|---|---|
| 4,490,582 | A | 12/1984 | Munson | |
| 5,469,111 | A | 11/1995 | Chiu | |
| 5,517,140 | A | 5/1996 | Hatsuda | |
| 5,589,799 | A * | 12/1996 | Madaffari | H03F 3/1855 330/277 |
| 5,804,958 | A * | 9/1998 | Tsui | G05F 3/262 323/313 |
| 5,978,491 | A * | 11/1999 | Papadopoulos | H04R 19/016 381/111 |

(Continued)

*Primary Examiner* — Yosef K Laekemariam
(74) *Attorney, Agent, or Firm* — Alphapatent Associates, Ltd; Daniel J. Swirsky

(57) ABSTRACT

A method and a system for ultra-low-power acoustic sensor including a buffer transistor, which gate terminal is connected to a first terminal of a capacitive acoustic sensor, which drain terminal is connected via a load network to a power source and to an output terminal, and which source terminal is connected to the regulated current source, where the regulated current source is connected between the source terminal of the buffer transistor and a reference terminal, and where the reference terminal being connectable to a second terminal of the capacitive acoustic sensor.

32 Claims, 23 Drawing Sheets

(56) References Cited

U.S. PATENT DOCUMENTS

| | | | |
|---|---|---|---|
| 2005/0093724 | A1 | 5/2005 | Berg |
| 2006/0100001 | A1 | 5/2006 | Pratt |
| 2007/0217628 | A1 | 9/2007 | Boor |
| 2009/0122649 | A1 | 5/2009 | Novick et al. |
| 2011/0228954 | A1 | 9/2011 | Saullespurnes et al. |
| 2012/0092020 | A1 | 4/2012 | Zhou |
| 2012/0306575 | A1 | 12/2012 | Shah et al. |

* cited by examiner 26
27
35
31
31
31
31
31
Electret Polarized
-Q1
+Qp
-Qp
+Q1
32
R
34
33
28
30
29
h0
hp
+MIC
-MIC 20
Vb
21
R
Cmic
22
Ccop
24
Vin
23
A
Vout
25
Cin

70

87

100

106

115

SYSTEMS AND METHODS FOR USING ELECTROSTATIC MICROPHONE

CROSS-REFERENCE TO RELATED APPLICATIONS

This application is a U.S. National Phase Application under 35 U.S.C. 371 of International Application No. PCT/IB2014/067325, which has an international filing date of Dec. 25 2014, and which claims the priority benefit of U.S. Provisional Patent Application No. 61/920,759, filed Dec. 25, 2013, and U.S. Provisional Patent Application No. 61/926,794, filed Jan. 13, 2014, both of which applications are incorporated herein by reference in their entirety.

FIELD OF THE INVENTION

The present invention generally relates to systems and methods using electrostatic microphone, and, more particularly, but not exclusively, to low power consumption operating electret condenser microphones.

BACKGROUND OF THE INVENTION

Electrostatic microphones are known in the art. Perhaps the most widely used electrostatic microphone is the electret condenser microphone. An electret condenser microphone uses a piece of electret, which is a permanently charged material, and behaves as a capacitor. Variations in air pressure produced by sound waves change the capacitance of the electret-charged capacitor, thus the permanent charge creates corresponding variations of the voltage across the capacitor. The voltage is then amplified to produce an electric signal corresponding to the sound waves.

The proliferation of very small battery operated devices as well as the proliferation of wireless personal area networking (WPAN) and wireless body area networking (WBAN) create a demand for communication methods consuming very low power.

There is thus a recognized need for, and it would be highly advantageous to have, a method and a system for low power operation of electrostatic microphones, and particularly electret condenser microphones, that overcomes the above-mentioned deficiencies.

SUMMARY OF THE INVENTION

Unless otherwise defined, all technical and scientific terms used herein have the same meaning as commonly understood by one of ordinary skill in the art to which this invention belongs. The materials, methods, and examples provided herein are illustrative only and not intended to be limiting. Except to the extent necessary or inherent in the processes themselves, no particular order to steps or stages of methods and processes described in this disclosure, including the figures, is intended or implied. In many cases the order of process steps may vary without changing the purpose or effect of the methods described.

Implementation of the method and system of the present invention involves performing or completing certain selected tasks or steps manually, automatically, or any combination thereof. Moreover, according to actual instrumentation and equipment of preferred embodiments of the method and system of the present invention, several selected steps could be implemented by hardware or by software on any operating system of any firmware or any combination thereof. For example, as hardware, selected steps of the invention could be implemented as a chip or a circuit. As software, selected steps of the invention could be implemented as a plurality of software instructions being executed by a computer using any suitable operating system. In any case, selected steps of the method and system of the invention could be described as being performed by a data processor, such as a computing platform for executing a plurality of instructions.

According to one aspect of the present invention there is provided a device and/or a method including a current source, and a buffer transistor, which gate terminal is connected to a first terminal of a capacitive acoustic sensor, which drain terminal is connected via a load network to a power source and to an output terminal, and which source terminal is connected to the regulated current source, where the regulated current source is connected between the source terminal of the buffer transistor and a reference terminal, and where the reference terminal being connectable to a second terminal of the capacitive acoustic sensor.

According to another aspect of the present invention there is provided a device and/or a method where the buffer transistor has a relatively high drain current at zero bias (Idss), and where the regulated current source forces a relatively low drain-source current via the buffer transistor.

According to still another aspect of the present invention there is provided a device and/or a method where the current source is based on a current mirror circuit.

According to yet another aspect of the present invention there is provided a device and/or a method where the current source includes a comparator device to set the bias current of the buffer to a pre-defined value.

According to even another aspect of the present invention there is provided a device and/or a method including a buffer transistor, which gate terminal is connected to a first terminal of an capacitive acoustic sensor, which drain terminal is connected via a load network to a power source and to an output terminal, and which source terminal is connected via a resistor to a reference terminal, and a regulated voltage source connected between a second terminal of the acoustic sensor and the reference terminal.

Further according to another aspect of the present invention there is provided a device and/or a method where the buffer transistor has a relatively high drain current at zero bias (Idss), and where the regulated voltage source provides one or more of: a negative voltage at the gate terminal of the buffer transistor relative to the source terminal of the buffer transistor if the buffer transistor has an N-channel, and a positive voltage at the gate terminal of the buffer transistor relative to the source terminal of the buffer transistor if the buffer transistor has an P-channel.

Still further according to another aspect of the present invention there is provided a device and/or a method where the power source includes a comparator device for determining operating point of the buffer transistor.

Yet further according to another aspect of the present invention there is provided a device and/or a method where the buffer transistor is one or more of: a field effect transistor (FET), a jFET and a MOSFET.

Even further according to another aspect of the present invention there is provided a device and/or a method where the buffer transistor is selected according to one or more of: a minimum Length L, a maximum Width W, a large current through the device, and a minimum input capacitance.

Additionally, according to another aspect of the present invention there is provided a device and/or a method where the capacitive acoustic sensor is one or more of: an acoustic sensor behaving as a capacitor where the capacity changes responsive to one or more of air pressure and air vibration, an electret condenser microphone (ECM), and a micro-electro-mechanical-system (MEMS) microphone.

According to yet another aspect of the present invention there is provided a device and/or a method where the buffer transistor is operative in one or more of: saturation region and ohmic region.

According to still another aspect of the present invention there is provided a device and/or a method additionally including a sample-and-hold circuit operative to control supply of operating voltage to one or more of the FET, a current source and a power source, and where operation of the sample-and-hold circuit is synchronized with operation of the supply of operating voltage to one or more of the FET, the current source and the power source.

Further according to another aspect of the present invention there is provided a device and/or a method additionally including a voltage follower circuit providing bias voltage to a sample-and-hold capacitor.

Yet further according to another aspect of the present invention there is provided a device and/or a method where the load network connecting the drain terminal of the buffer transistor and the power source is one or more of a resistor and a resonator circuit.

Still further according to another aspect of the present invention there is provided a device and/or a method as described above and additionally including a radio unit including one or more of a radio receiver, a radio transmitter, and a radio transceiver, where the device is operative to wake-up the radio unit from sleep mode upon detecting a predefined acoustic signal.

Even further according to another aspect of the present invention there is provided a device and/or a method as described above and additionally including a filter array operative to detect a plurality of acoustic tones.

Additionally, according to another aspect of the present invention there is provided a device and/or a method as described above and additionally including a radio unit including one or more of a radio receiver, a radio transmitter, and a radio transceiver, and a filter array operative to detect a plurality of acoustic tones, where one or more of the plurality of acoustic tones is modulated, and where the device is operative to wake-up the radio unit form sleep mode upon detecting a predefined acoustic signal.

According to yet another aspect of the present invention there is provided a device and/or a method as described above and where the modulation includes one or more of: a different starting time, a different ending time, and a different amplitude.

According to still another aspect of the present invention there is provided a device and/or a method as described above and a wireless unit including one or more of: a receiver, a transmitter and a transceiver, an acoustic sensor, a sensing circuitry coupled to the wireless unit and to the acoustic sensor, where the sensing circuitry is operative to detect a predefined acoustic signal collected by the acoustic sensor, and where the sensing circuitry is operative to provide a signal to initiate operation of the wireless unit.

Further according to another aspect of the present invention there is provided a device and/or a method as described above and additionally including a filter array operative to detect a plurality of acoustic tones.

Yet further according to another aspect of the present invention there is provided a device and/or a method as described above where one or more of the plurality of acoustic tones is modulated.

Still further according to another aspect of the present invention there is provided a device and/or a method as described above and where the modulation includes one or more of: a different starting time, a different ending time, and a different amplitude.

Even further according to another aspect of the present invention there is provided a device and/or a method as described above and additionally including a sample-and-hold circuit, where the sample-and-hold circuit is additionally operative to control supply of operating voltage to one or more of the buffer transistor, a current source to the buffer transistor, and a voltage source to the acoustic sensor, and where operation of the sample-and-hold circuit is synchronized with operation of the supply of operating voltage to one or more of the buffer transistor, the current source and the voltage source.

Additionally, according to another aspect of the present invention there is provided a device and/or a method as described above additionally including a voltage follower circuit providing bias voltage to a sample-and-hold capacitor.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DETAILED DESCRIPTION

Figure 1:
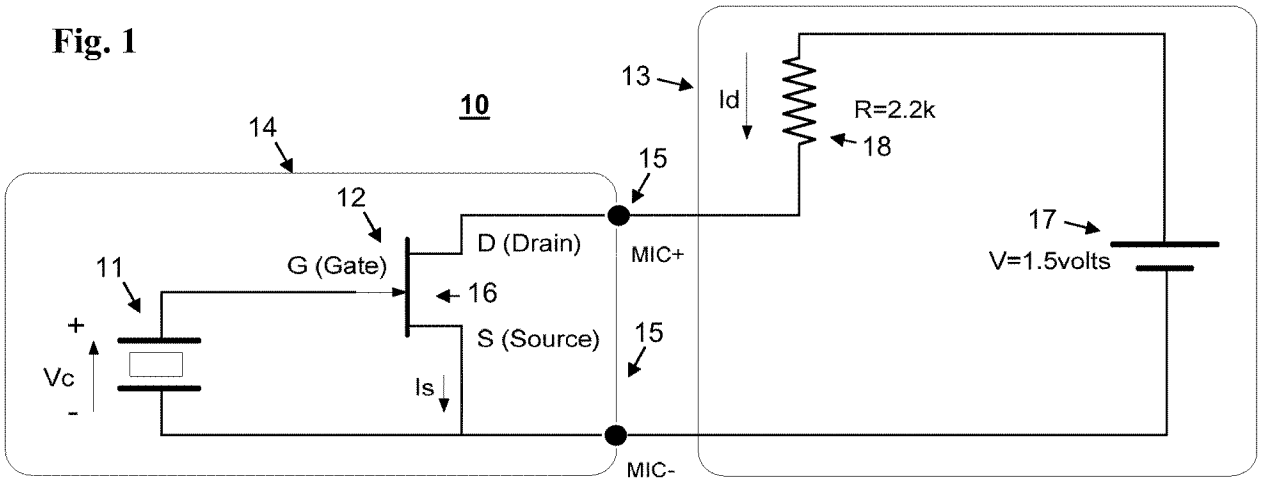
FIG. 1 is a simplified schematic diagram of an ECM electrical circuitry with a bias circuit.

The principles and operation of a method and a system for using an electrostatic microphone, and, more particularly, but not exclusively, to low power consumption circuitry for operating electret condenser microphones may be better understood with reference to the drawings and accompanying description.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

In this document, an element of a drawing that is not described within the scope of the drawing and is labeled with a numeral that has been described in a previous drawing has the same use and description as in the previous drawings. Similarly, an element that is identified in the text by a numeral that does not appear in the drawing described by the text, has the same use and description as in the previous drawings where it is described.

The purpose of the systems and methods described in this document is to use an electrostatic microphone while consuming minimum electric power. As a non-limiting example, the electrostatic microphone is embodied as an electret condenser microphone, also known as an electret microphone or ECM. The structure of an electret condenser microphone is well known and electret condenser microphones can be acquired from diverse sources.

One further purpose of the systems and methods described in this document is to enable acoustic communication such as shown and described in U.S. provisional application for a patent No. 61/856,729 filed in Jul. 21, 2013, U.S. provisional application for a patent No. 61/856,730 also filed in Jul. 21, 2013, and U.S. provisional application for a patent No. 62/021,018 filed Jul. 4, 2014, as well as PCT application No. PCT/IB2014/063266 filed Jul. 21, 2014 claiming priority from these US provisional patent applications, all of which are incorporated herein by reference.

Acoustic communication may be used to implement a wireless personal area network (WPAN) or wireless body area network (WBAN). Acoustic communication is particularly useful for low power WPAN or WBAN. Acoustic communication is particularly useful for detecting a beacon signal, or a wakeup signal provided to turn on an electric circuitry in stand-by mode. In such case a battery operated device is put in stand-by mode to save battery power. A beacon signal, or a wakeup signal, or any similar acoustic signal is sent to the device to wake it up from the stand-by mode. Therefore, while in stand-by mode, the device is 'listening' to the environment to detect such beacon signal, or a wakeup signal. This listening mode should have very low power consumption, which the device described herein may provide.

For example, currently an ECM requires a bias current of 500 μA to 1000 μA. However, a typical coin battery provides 10 mAh-250 mAh, and therefore, a 500 ua ECM will drain a 10 mAh battery in just 20 hours. The purpose of the ECM circuitry described herein is to drain less than 1 micro-Amper, providing about 10,000-250,000 working hours from the same coin battery.

Reference is now made to FIG. 1, which is a simplified schematic diagram of an ECM electrical circuitry 10 with a bias circuit, according to one possible embodiment.

As shown in FIG. 1, ECM electrical circuitry 10 may include an electret condenser microphone (ECM) 11, a buffer circuit 12 and a bias circuit 13. Typically, the ECM 11 and the buffer circuit 12 are provided together, embedded in a microphone device 14 having two terminals 15 designated as MIC+ and MIC− to which the bias circuit connects. As shown in FIG. 1 by way of an example, the buffer circuit includes a transistor 16. Transistor 16 operates as a buffer transistor, and is typically a field effect transistor (FET), typically a junction gate field-effect transistor (jFET) or a MOSFET transistor. Transistor 16 may be named herein simply FET or jFET. The bias circuit of FIG. 1 may also include a battery 17 and a bias resistor 18. Electric current Id flows from battery 17 via resistor 18 into the drain terminal of jFET 16. Electric current Id flows from the source terminal of jFET 16 back to battery 17.

It is appreciated that the circuits described herein use an electret condenser microphone (ECM) as the sound sensing device, however, these circuits, with necessary modifications, may apply to other types of microphones and/or sound sensing devices. Particularly, the systems and methods contemplated and described herein may apply to other types of condenser microphones, and/or microphones that change their capacitance as a function of air vibrations and/or sound. For example, the systems and methods contemplated and described herein may apply to microphones using micro-electro-mechanical system (MEMS) technologies.

Typically, the ECM 11 has a capacitance C which includes a polarized electret with charge Q. Therefore, the voltage across the capacitor C of the ECM (before connecting it to the jFET), is Vc=Q/Ce where Ce is the electret capacitance. The jFET has input capacitance designated as Cgs.

This voltage could be as high as possible to increase the sensitivity of the microphone, and low enough not to cause breakdown. The dielectric strength in air is 3,000,000 V/m, which means that for the width of 0.1 mm-1 mm the maximum voltage is 300-3,000V respectively, which limits the value of the charge Q of the pre-charge electret element 11. As the voltage Vc=Q/Ce across the electret element 11 may be relatively high, a resistor is added in parallel to the electret element 11, forcing the electret element 11 to discharge to zero Volts. In terms of physical phenomena, at first the electret element 11 is pre-charged with a charge Q and the voltage on the electret element is $$\frac{Q}{C_e}\left[\frac{1}{\frac{1}{C_e}+\frac{1}{C_{gs}}+\frac{1}{C_2}}\right]\left[\frac{1}{C_{gs}}\right]$$

where $C_2$ is the capacitance of the air gap inside the electret element 11. If Cgs is very small, this voltage could be as high as Q/Ce.

Adding a resistor in parallel to the electret element creates a negative electric force on the electret element 11. Therefore. the voltage across the electret element is exactly zero. In other words, a negative charge −Q is created on the plates of the electret element 11 capacitor forcing the voltage on the electret element to be zero (as further explained below). The jFET is essential in this circuit as a buffer to the pre-charged capacitor C.

Figure 2:
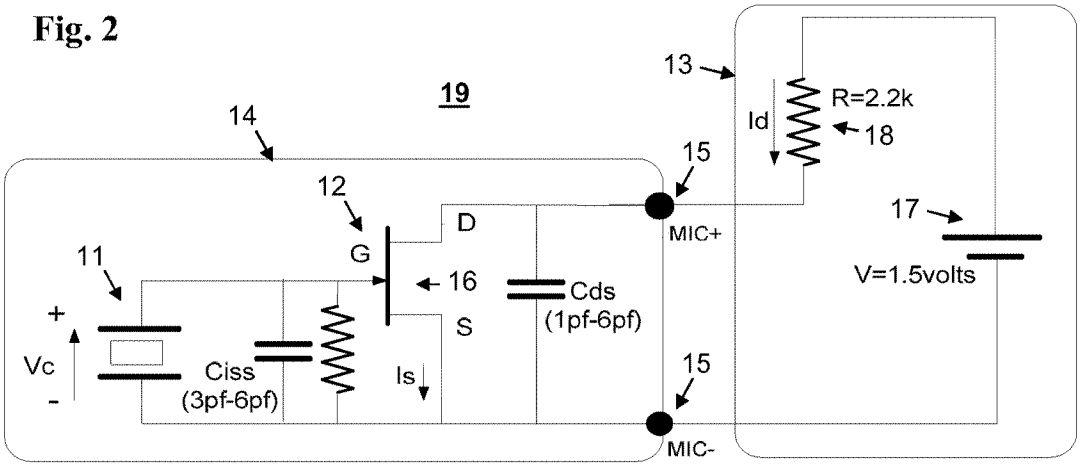
FIG. 2 is a simplified schematic diagram of an ECM electrical circuitry with jFET impairments.

Reference is now made to FIG. 2, which is a simplified schematic diagram of an ECM electrical circuitry 19 with jFET impairments, according to one possible embodiment. As an option, the electrical circuitry 19 may be viewed in the context of the details of the previous Figs. Of course, however, the ECM electrical circuitry 19 may be viewed in the context of any desired environment. Further, the aforementioned definitions may equally apply to the description below.

Electrical circuitry 19 is similar to electric circuitry 10 also showing jFET input capacitance Ciss, typically about 3 to 6 pico Farad, and output capacitance Cds, typically about 1 to 6 pico Farad.

Connecting a positive voltage 17 through resistor 18 would cause the jFET to work in the saturation region. Acoustic wave propagating in the air and reaching the ECM would create a change dC of the ECM capacitance C, thus affecting voltage Vgs(ac) at the jFET gate terminal as shown by equation 1.

$$V_{gs(ac)} = -dC\frac{Q}{C^2}\left[\frac{1}{\left(1+\frac{Ciss\cdot dC}{C^2}\right)}\right] = \left[Q_p\frac{h_p}{h_0+h_p}\right] \quad \text{Eq. 1}$$

-continued $$\frac{\left[\frac{\Delta h_0}{\varepsilon_0 A}\right]\frac{1}{Ciss}}{\left[\frac{\Delta h_0}{\varepsilon_0 A}+\frac{1}{Ciss}\right]} = \left[Q_p\frac{h_p}{h_0+h_p}\right]\left[\frac{\Delta h_0}{\varepsilon_0 A}\right]\frac{\frac{1}{Ciss}}{\left[\frac{\Delta h_0}{\varepsilon_0 A}+\frac{1}{Ciss}\right]}$$

Figure 3:
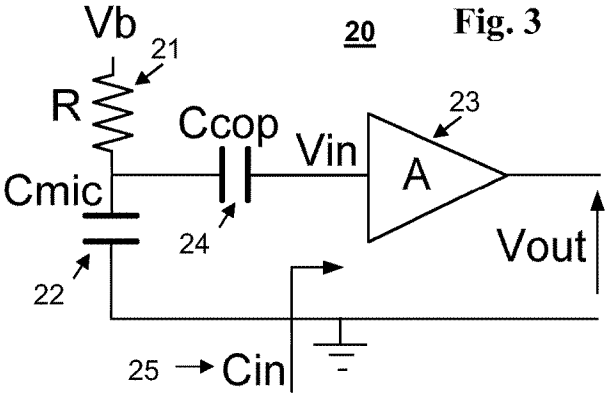
FIG. 3 is a simplified schematic diagram of a capacitor based microphone circuit.

Reference is now made to FIG. 3, which is a simplified schematic diagram of a capacitor based microphone circuit 20, according to one possible embodiment. As an option, the capacitor based microphone circuit 20 may be viewed in the context of the details of the previous Figs. Of course, however, the capacitor based microphone circuit 20 may be viewed in the context of any desired environment. Further, the aforementioned definitions may equally apply to the description below.

As shown in FIG. 3, bias voltage Vb is connected via a resistor 21 (of value R) to a variable capacitor 22 (of value Cmic), which changes it capacitance as a function of acoustic pressure. The capacitor 22 is coupled to an amplifier 23 (A) via a coupling capacitor 24 (of value Ccop).

In steady state the capacitor 22 would be charged to Vb. Hence, assuming that Ccop>>Cin, the charge stored in capacitor 22 and in the equivalent capacitor 24 and capacitance 25 (of value Cin) is Q=Vb(Cmic+Cin). Assuming that acoustic pressure changes capacitor 22 and the time constant RCmic is large enough such that the charge Q would not change, hence:

$$\begin{aligned} Q &= (V_b+\Delta V)(C_{mic}+\Delta C_{mic}+C_{in}) \\ &\approx V_b(C_{mic}+C_{in})+V_b\Delta C_{mic}+\Delta V(C_{mic}+C_{in}) \\ &= V_b\Delta C_{mic}+\Delta V(C_{mic}+C_{in}) \Rightarrow \Delta V = \\ &\quad -V_b\left[\frac{\Delta C_{mic}}{C_{mic}}\right]\left[\frac{1}{1+\frac{C_{in}}{C_{mic}}}\right] \end{aligned}$$

or $$V_{in} = -V_b\left[\frac{\Delta C_{mic}}{C_{mic}}\right]\left[\frac{1}{1+\frac{C_{in}}{C_{mic}}}\right] \quad \text{Eq. 2}$$

The amplifier 23 may be built using a FET transistor and in this case, for example a common source amplifier.

Figure 4:
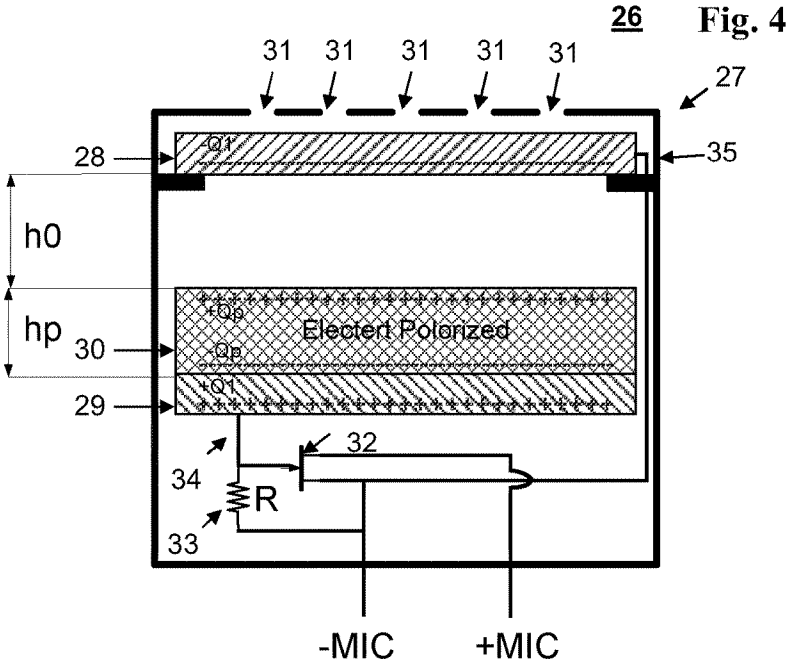
FIG. 4 is a simplified schematic diagram of an electret condenser microphone.

Reference is now made to FIG. 4, which is a simplified schematic diagram 26 of an electret condenser microphone 27, according to one possible embodiment. As an option, the simplified schematic diagram 26 may be viewed in the context of the details of the previous Figs. Of course, however, the simplified schematic diagram 26 may be viewed in the context of any desired environment. Further, the aforementioned definitions may equally apply to the description below.

As shown in FIG. 4, electret microphone is described, the electret microphone 27 may include an upper elastic conductive plate 28, a lower conductive back plate 29, and electret material 30. Electret material 30 may be permanently polarized with a positive charge of value +Qp, applied, for example, to the upper layer of the permanently polarized electret material 30, and negative charge of value −Qp applied, for example, to the lower layer of the permanently polarized electret material 30. The upper elastic conductive plate 28, and lower conductive back plate 29, together, form a capacitor of value C. When acoustic waves propagates through holes 31 the upper plate may bend causing capacitance C to change and consequently resulting in a voltage change relative to the change of acoustic pressure.

As shown in FIG. 4, upper elastic conductive plate 28 and lower conductive back plate 29 are connected to a buffer transistor 32, because the impedance of the capacitor C is extremely high. As shown in FIG. 4, a resistor 33 is connected between the terminals 34 and 35 of the capacitor created between upper elastic conductive plate 28 and lower conductive back plate 29.

The voltage in steady state on the capacitor terminals 34, 35 would be exactly zero. A charge +Q1 may be induced on the back (outer) side of lower conductive back plate 29, and a charge −Q1 may be induced on the back (outer) side of upper elastic conductive plate 28. Therefore, according to the theory of electric fields from charged discs with small distance, equation 3 represent the electric field:

$$E = \begin{cases} \frac{2Q_p}{2\varepsilon_0 A} - \frac{2Q_1}{2\varepsilon_0 A} & \text{electert} \\ -\frac{2Q_1}{2\varepsilon_0 A} & \text{air} \end{cases} \quad \text{Eq. 3}$$

Hence, the sum of voltages on electret and air should be zero or, as provided by equation 4:

$$h_p\left[\frac{Q_p}{\varepsilon_0 A} - \frac{Q_1}{\varepsilon_0 A}\right] - h_0\frac{Q_1}{\varepsilon_0 A} = 0 \Rightarrow Q_1 = Q_p\frac{h_p}{h_0 + h_p} \quad \text{Eq. 4}$$

For example, a small change on $h_0$ from $h_0$ to $h_0+\Delta h_0$ may result in a voltage change (assuming that the charge on the upper and lower plates does not change quickly) as shown in equation 5:

$$\Delta V = -Q_p\frac{h_p\Delta h_0}{\varepsilon_0 A(h_0 + h_p)} = -\left[Q_p\frac{h_p}{h_0 + h_p}\right]\frac{\Delta h_0}{\varepsilon_0 A} \quad \text{Eq. 5}$$

The above analysis is based on chapter 6 of MIT OpenCourseWare available at:

http://ocw.mit.edu/resources/res-6-001-electromagnetic-fields-and-energy-spring-2008/chapter-6/06.pdf It is therefore possible to define the electret capacitor of the capacitor formed by the upper elastic conductive plate 28 and lower conductive back plate 29 as depicted by equation 6:

$$C = \frac{\varepsilon_0 A}{(h_0 + h_p)} \Rightarrow Q\frac{\Delta C}{C^2} = Q\frac{\Delta h_0}{\varepsilon_0 A} \quad \text{Eq. 6}$$

The Q referred in equation 1 is Q1. The Ciss in the steady stage is charged with zero charge as the voltage across the capacitor terminals 34, 35 is zero. With Ciss it is apparent that the charge is not changing but some charge may move from upper elastic conductive plate 28 and lower conductive back plate 29 to Ciss back and forth. Therefore, the voltage change is provided by equation 7:

$$\Delta V = \left[Q_p\frac{h_p}{h_0 + h_p} - Q_2\right]\frac{\Delta h_0}{\varepsilon_0 A} = \frac{Q_2}{Ciss} \Rightarrow \left[Q_p\frac{h_p}{h_0 + h_p} - Q_2\right] \quad \text{Eq. 7}$$

This implies that for small $\Delta h_0$ changes $$Q_2 = \left[Q_p\frac{h_p}{h_0 + h_p}\right]\frac{\frac{\Delta h_0}{\varepsilon_0 A}}{\frac{\Delta h_0}{\varepsilon_0 A} + \frac{1}{Ciss}} \Rightarrow \Delta V = \left[Q_p\frac{h_p}{h_0 + h_p}\right]\frac{\left[\frac{\Delta h_0}{\varepsilon_0 A}\right]\frac{1}{Ciss}}{\left[\frac{\Delta h_0}{\varepsilon_0 A} + \frac{1}{Ciss}\right]}$$

or $$\Delta V = \left[Q_p\frac{h_p}{h_0 + h_p}\right]\frac{\left[\frac{\Delta h_0}{\varepsilon_0 A}\right]\frac{1}{Ciss}}{\left[\frac{\Delta h_0}{\varepsilon_0 A} + \frac{1}{Ciss}\right]}$$

And therefore, for $$\frac{\Delta h_0}{\varepsilon_0 A} << \frac{1}{Ciss}$$

$$\Delta V = \left[Q_p\frac{h_p}{h_0 + h_p}\right]\left[\frac{\Delta h_0}{\varepsilon_0 A}\right]$$

As in the original analysis not taking into account the Ciss.

As seen from Eq. 1, Ciss plays an important role, as a higher Ciss may generate attenuation at the input.

Figure 5:
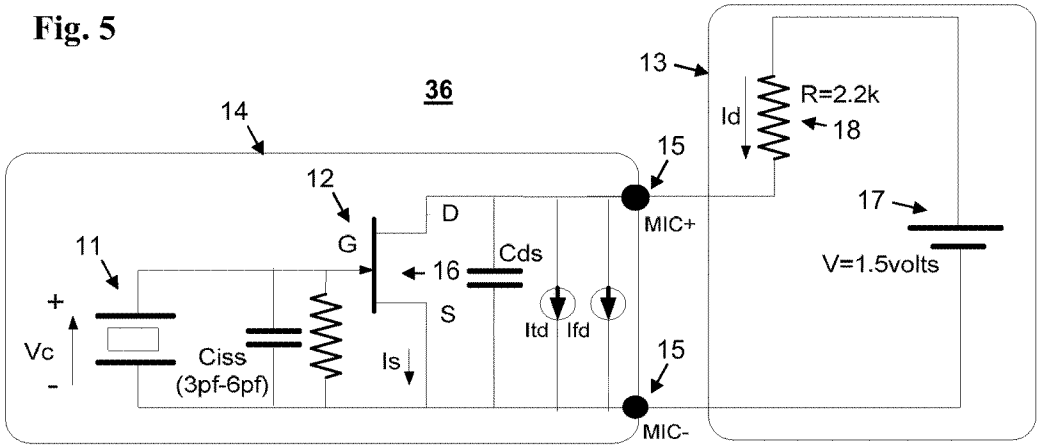
FIG. 5 is a simplified schematic diagram of an ECM electrical circuitry with a noise model.

Reference is now made to FIG. 5, which is a simplified schematic diagram of an ECM electrical circuitry 36 with a noise model, according to one possible embodiment. As an option, the electrical circuitry 36 may be viewed in the context of the details of the previous Figs. Of course, however, the ECM electrical circuitry 36 may be viewed in the context of any desired environment. Further, the aforementioned definitions may equally apply to the description below.

Electrical circuitry 36 includes a noise model based on information provided in chapter 5 "jFET noise" of EE6416 LOW NOISE ELECTRONIC DESIGN—Course book Chapter 5, available at http://users.ece.gatech.edu/~mleach/ece6416/Labs/exp05.pdf. The jFET noise is thus given by equations 8 and 9:

$$i_{td}^2 = 4KT\left(\frac{2}{3}g_m\right)\Delta f \quad \text{Eq. 8}$$

$$i_{fd}^2 = 4KT\left(\frac{2}{3}g_m\right)\left(\frac{f}{f_L}\right)\Delta f \quad \text{Eq. 9}$$

where "td" stands for "thermal drain" and "fd" for the "flicker drain".

Herein below the noise term is described by the equation:

$$i_n^2 = K_n g_m \quad \text{Eq. 10}$$

The general drain current in the saturation region is given by equation 11, where $g_m$ is given by equation 12.

$$I_d = I_{dss}\left(1 - \frac{Vgs}{Vp}\right)^2 \quad \text{Eq. 11}$$

-continued $$g_m \equiv \frac{\partial I_d}{\partial Vgs} = 2I_{dss}\left(\frac{-1}{Vp}\right)\left(1-\frac{Vgs}{Vp}\right) = \frac{-2I_{dss}}{Vp}\sqrt{\frac{I_d}{I_{dss}}} = -\frac{2}{Vp}\sqrt{I_{dss}I_d} \quad \text{Eq. 12}$$

Therefore, the output voltage due to the input signal according to Equation 1 is given by equation 13:

$$V_{out(ac)} = -\left[Q_p\frac{h_p}{h_0+h_p}\right]\left[\frac{\Delta h_0}{\varepsilon_0 A}\right]\frac{\frac{1}{Ciss}}{\left[\frac{\Delta h_0}{\varepsilon_0 A}+\frac{1}{Ciss}\right]}g_m \quad \text{Eq. 13}$$

$$R == \left[Q_p\frac{h_p}{h_0+h_p}\right]\left[\frac{\Delta h_0}{\varepsilon_0 A}\right]\frac{\frac{1}{Ciss}}{\left[\frac{\Delta h_0}{\varepsilon_0 A}+\frac{1}{Ciss}\right]}\frac{2}{Vp}\sqrt{I_{dss}I_d}\,R$$

The output voltage is therefore a function of electric current Id, and therefore maximizing Id maximizes the output. Hence the maximal output is provided when $I_d = I_{dss}$ Therefore, if R in the term $$\frac{2I_{dss}R}{Vp}$$

is designed to compensate the attenuation given by the term $$\frac{\frac{1}{Ciss}}{\left[\frac{\Delta h_0}{\varepsilon_0 A}+\frac{1}{Ciss}\right]}$$

Typical values are: $I_{dss}$=500 μA, $V_p$=−1 v, $C_{iss}$=3 pF, C=3 pF, R=2.2 KμΩ.

For the above typical values we get $$\frac{2I_{dss}R}{Vp} = 2.2$$

and the total gain for the microphone is 2.2 or −6 dB for small Ciss. It is possible to increase R to 4K but then the supply voltage should give $V_{ds} > -V_p$ (assuming $V_{gs}$=0). This means that the supply voltage should be 3 v or more.

It is possible to increase the value of the term $$\frac{2}{Vp}\sqrt{I_{dss}I_d}\,R$$

by using a smaller Id.

And, on the other hand, to increase R and still keep the jFET in the saturation region.

Figure 6:
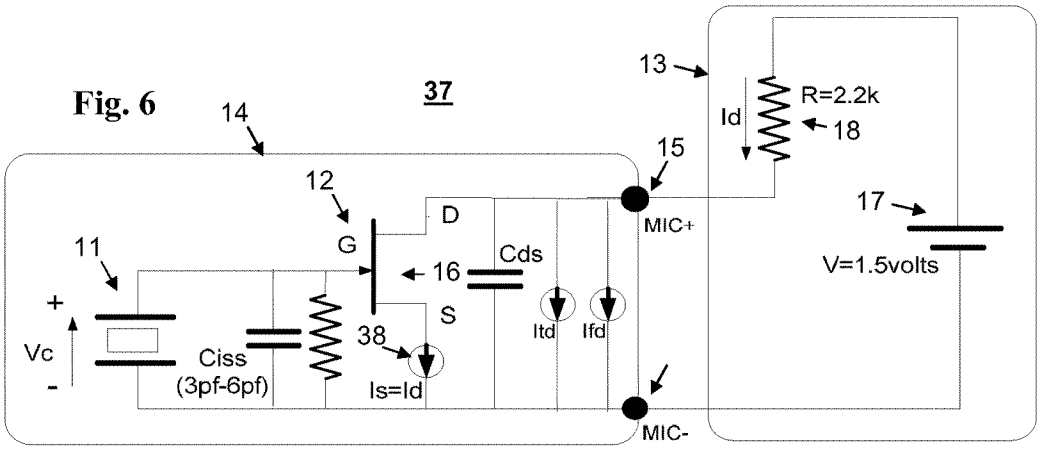
FIG. 6 is a simplified schematic diagram of an ECM electrical circuitry with controlled bias ID.

Reference is now made to FIG. 6, which is a simplified schematic diagram of an ECM electrical circuitry 37 with controlled bias ID, according to one possible embodiment. As an option, the electrical circuitry 37 may be viewed in the context of the details of the previous Figs. Of course, however, the ECM electrical circuitry 37 may be viewed in the context of any desired environment. Further, the aforementioned definitions may equally apply to the description below.

Electrical circuitry 37 is similar to electric circuitry 19 with the addition of a controlled current source 38 providing a bias current Id. According to equation 13 it is possible to make the term $$\frac{2}{Vp}\sqrt{I_{dss}I_d}\,R$$

large enough to compensate for attenuation with a smaller Id, and on the other hand to increase R and still keep the jFET in the saturation region.

The Signal to Noise Ratio (SNR) decreases with current Id. The noise voltage variance at the output is given by equation 14, and the output voltage is given by equation 15.

$$v_n^2 = K_n g_m R^2 \quad \text{Eq. 14}$$

$$V_{out(ac)}^2 = \left(\left[Q_p\frac{h_p}{h_0+h_p}\right]\left[\frac{\Delta h_0}{\varepsilon_0 A}\right]\right)^2\left(\frac{\frac{1}{Ciss}}{\left[\frac{\Delta h_0}{\varepsilon_0 A}+\frac{1}{Ciss}\right]}\right)^2 g_m^2 R^2 \quad \text{Eq. 15}$$

Neglecting the thermal noise from the resistor R, it is possible to determine the SNR according to equation 16.

$$SNR = \left(\left[Q_p\frac{h_p}{h_0+h_p}\right]\left[\frac{\Delta h_0}{\varepsilon_0 A}\right]\right)^2\left(\frac{\frac{1}{Ciss}}{\left[\frac{\Delta h_0}{\varepsilon_0 A}+\frac{1}{Ciss}\right]}\right)^2 g_m\frac{1}{K_n} = \left(\left[Q_p\frac{h_p}{h_0+h_p}\right]\left[\frac{\Delta h_0}{\varepsilon_0 A}\right]\right)^2\left(\frac{\frac{1}{Ciss}}{\left[\frac{\Delta h_0}{\varepsilon_0 A}+\frac{1}{Ciss}\right]}\right)^2\frac{2}{Vp}\sqrt{I_{dss}I_d} \quad \text{Eq. 16}$$

Thus, decreasing the bias current Id decreases the SNR. Therefore, retain the SNR value by decreasing Id by a factor of M and increasing Idss by a factor of M.

It is appreciated that increasing Idss affects the geometry of the transistor yielding higher Ciss. The Idss may be controlled by the width (W) length (L). Thus, it is possible to increase the Idss by using a minimal L with a large W. Such jFET device, for example is the IF140 available from InterFET, 715 N Glenville Dr., Richardson, Tex. 75081, USA.

Figure 7:
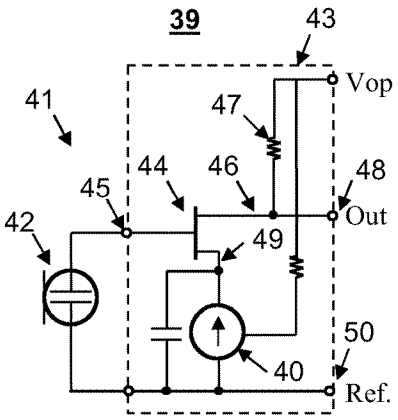
FIG. 7 is a simplified schematic diagram of an ECM electrical circuitry including controlled current source.

Reference is now made to FIG. 7, which is a simplified schematic diagram of an ECM electrical circuitry 39 including controlled current source 40, according to one possible embodiment. As an option, the electrical circuitry 39 may be viewed in the context of the details of the previous Figures. Of course, however, the ECM electrical circuitry 39 may be viewed in the context of any desired environment. Further, the aforementioned definitions may equally apply to the description below.

Electrical circuitry 39 shows a device 41 including an electret condenser microphone 42 and a buffer device 43. The buffer device 43 may include a Field Effect Transistor (FET) 44 (such as the jFET of any of the previous Figs.). The gate terminal 45 of the FET 44 may be connected to a first terminal of an electret condenser microphone 42. The drain terminal 46 of the FET 44 may be connected via a load network 47 to a power source Vop. The drain terminal 46 of the FET 44 may be connected also to an output terminal 48. The source terminal 49 of the FET 44 may be connected to regulated current source 40. The regulated current source 40 may be connected between the source terminal 49 of the FET 44 and a reference terminal 50. The reference terminal 50 may be connected also to a second terminal of the electret condenser microphone 42. It is appreciated that the FET 44 may have a relatively high drain current at zero bias (Idss), and the controlled (regulated) current source 40 may force a relatively low drain-to-source current via the FET 44. Thus providing a relatively high SNR at a relatively low power consumption.

Figure 8:
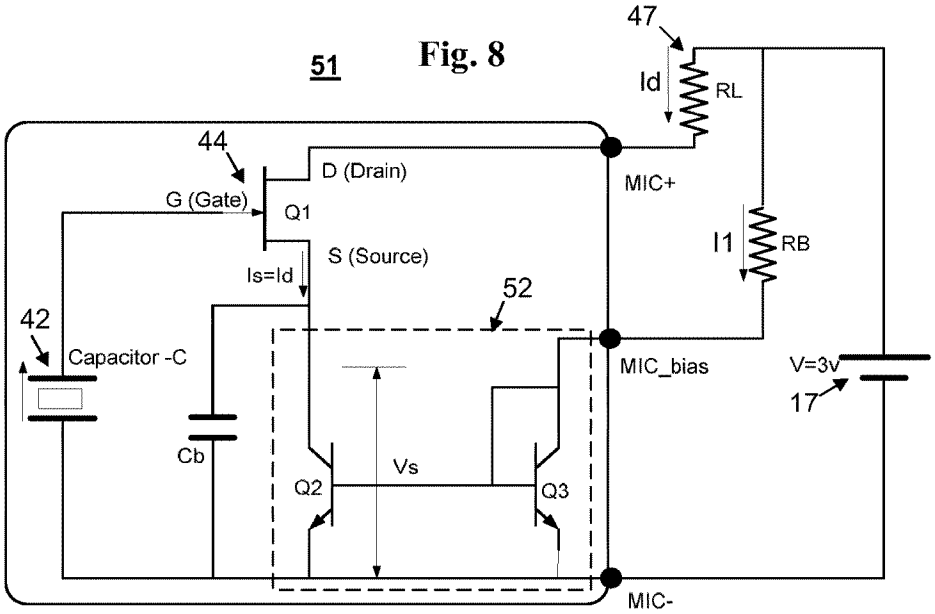
FIG. 8 is a simplified schematic diagram of an ECM electrical circuitry including a controlled mirror current source.

Reference is now made to FIG. 8, which is a simplified schematic diagram of an ECM electrical circuitry 51 including a controlled mirror current source 52, according to one possible embodiment. As an option, the electrical circuitry 51 may be viewed in the context of the details of the previous Figures. Of course, however, the ECM electrical circuitry 51 may be viewed in the context of any desired environment. Further, the aforementioned definitions may equally apply to the description below.

Electrical circuitry 51 is an exemplary embodiment of electrical circuitry 39 providing Idss current of 10 mA-50 mA with a low Ciss. Electrical circuitry 51 includes an ECM 42, a jFET 44, and a current source 52, which is a mirror current source. The jFET (Q1) 44 may have a higher Idss, such as 50 ma, with still low Ciss, so that the value of the term $$\frac{\frac{1}{Ciss}}{\left[\frac{\Delta h_0}{\varepsilon_0 A}+\frac{1}{Ciss}\right]}$$

may be close to 1.

Electrical circuitry 51 may therefore have SNR according to equation 17:

$$SNR=\frac{1}{K_n}\left(\left[Q_p\frac{h_p}{h_0+h_p}\right]\left[\frac{\Delta h_0}{\varepsilon_0 A}\right]\right)^2\left(\frac{\frac{1}{Ciss}}{\left[\frac{\Delta h_0}{\varepsilon_0 A}+\frac{1}{Ciss}\right]}\right)^2\frac{2}{Vp}\sqrt{I_{dss}I_d} \qquad \text{Eq. 17}$$

using a regular ECM, where Vgs=~0V, Idss=0.5 mA, Id=Idss=0.5 mA. As the Idss is M times bigger than the common jFET Idss it is possible to write equation 18 as follows:

$$\sqrt{I_{dss_old}I_{d_old}}=\sqrt{(MI_{dss_old})\left(\frac{I_{d_old}}{M}\right)} \qquad \text{Eq. 18}$$

Therefore the new Id is about 5 μA, according to equation 19:

$$I_{d_new}=\left(\frac{I_{d_old}}{M}\right)=\frac{5000\ ua}{100}=5\ \mu A \qquad \text{Eq. 19}$$

Transistors Q2 & Q3 are used as a current mirror. Therefore, if Q2 & Q3 are the same, then I1=Is=Id=5 μA. This conveys that the microphone may consume about 10 μA from a 3 v battery. A 3 v Battery is required because Vs is close to |Vp|. Because $R_L$ is small (for example 2.2 k), very low voltage is developed on $R_L$.

Maintaining jFET 44 in saturation mode we requires that Vds>Vgs−Vp and $$I_{d_new}=MI_{dss}\left(1-\frac{Vgs}{Vp}\right)^2 \text{ or} \qquad \text{Eq. 20}$$

$$V_{ds_min}= \qquad \text{Eq. 21}$$

$$Vgs-Vp=\sqrt{\frac{I_{d_new}Vp^2}{MIdss}}\ I_{d_new}=\frac{1}{M}|Vp|=\sim 3/100=30\text{ mV}$$

Therefore, the main consumption may come from the Vs=~−Vp. The battery voltage could be tuned such that $$0.3\leq V_{battery_min}=Vgs+Vds+IdR_L\leq 2 \qquad \text{Eq. 22}$$

Figure 9:
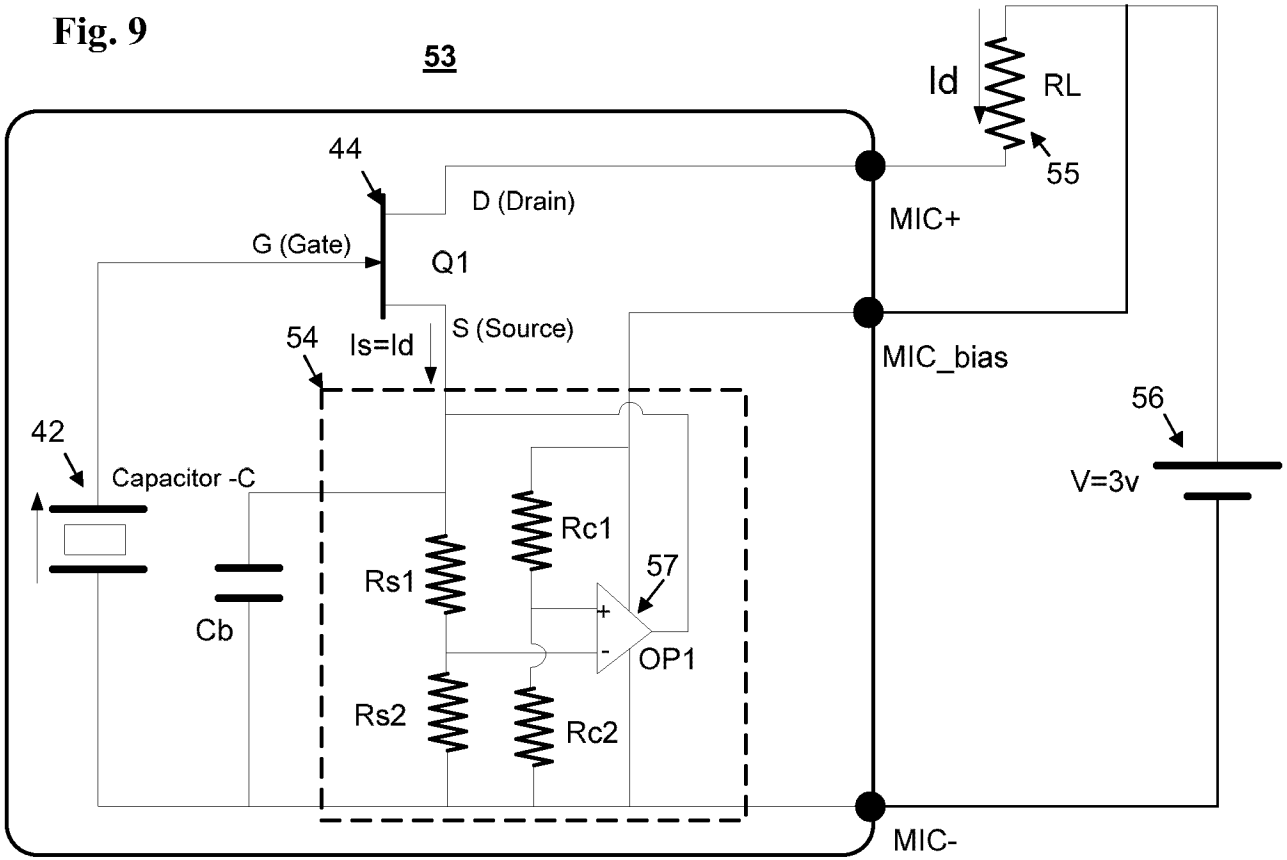
FIG. 9 is a simplified schematic diagram of a low power ECM electrical circuitry including a controlled current source.

Reference is now made to FIG. 9, which is a simplified schematic diagram of a low power ECM electrical circuitry 53 including a controlled current source 54, according to one possible embodiment. As an option, the electrical circuitry 53 may be viewed in the context of the details of the previous Figures. Of course, however, the ECM electrical circuitry 53 may be viewed in the context of any desired environment. Further, the aforementioned definitions may equally apply to the description below.

As shown in FIG. 9, low power ECM electrical circuitry 53 includes an ECM 42, a jFET 44, and controlled current source 54. The drain terminal of jFET 44 is connected via a load network 55 (resistor $R_L$) to a power source (battery) 56. The source terminal of jFET 44 is connected to controlled current source 54, which is also connected to the power source 56. The source terminal of jFET 44 is connected to the ECM 42, which other terminal, as well as the controlled current source 54, are connected to the negative side of power source (battery) 56.

As shown in FIG. 9, low power ECM electrical circuitry 53 uses another exemplary, non-limiting embodiment of the controlled current source. The controlled current source 54 uses an operational amplifier in a closed loop to bias the jFET 44. A load network designated by Rs1 and Rs2 samples the source current Id, which may be 5 μA. Load network Rs1-Rs2 enables using an operational amplifier 57 (also designated as OP1) with a limited output rail. For example, controlled current source 54 may use Vref=Vrc2=0.3 v and then Rs2=0.3/5 μA=60 kΩ. In this case the total current drawn by operational amplifier OP1 may be about 10 μA.

Figure 10:
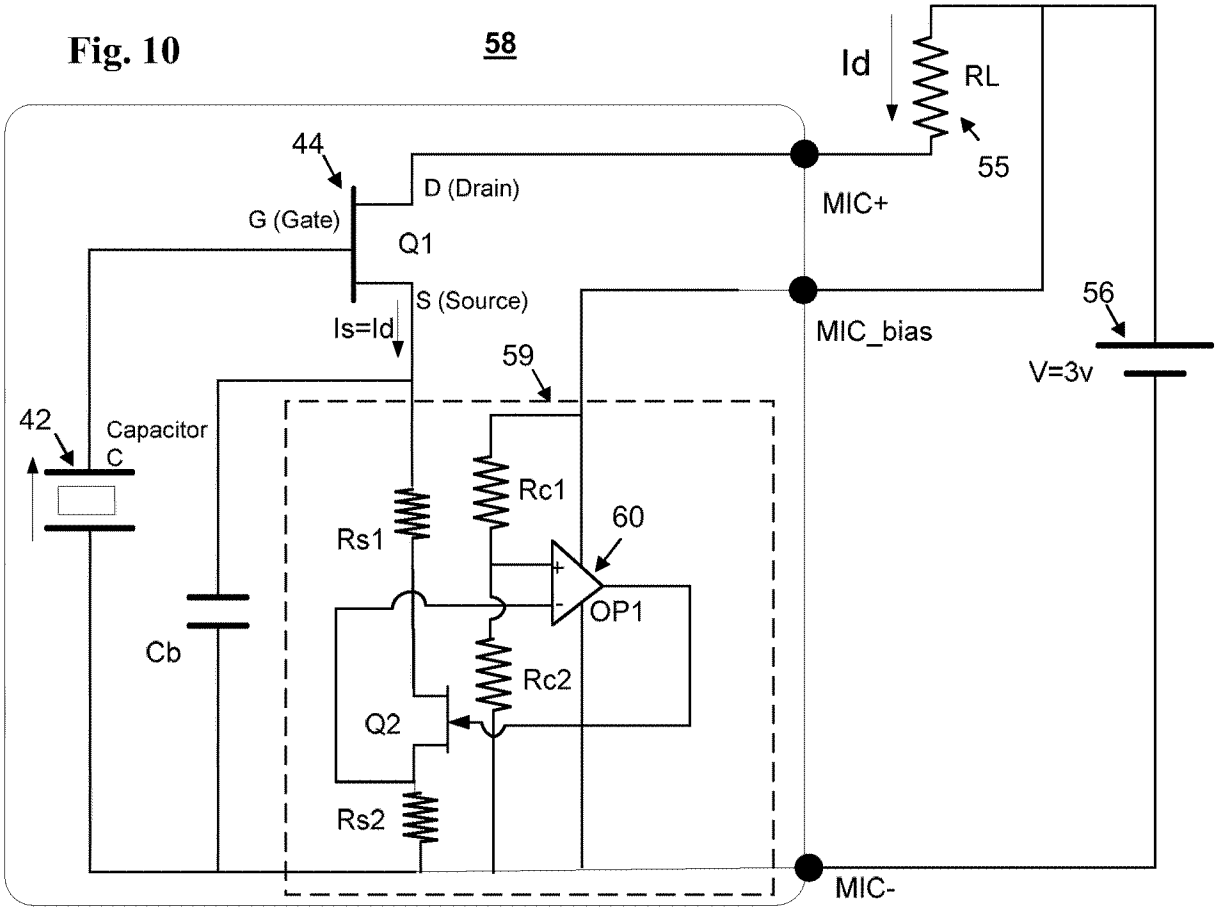
FIG. 10 is a simplified schematic diagram of a low power ECM electrical circuitry including a controlled current source.

Reference is now made to FIG. 10, which is a simplified schematic diagram of a low power ECM electrical circuitry 58 including a controlled current source 59, according to one possible embodiment. As an option, the electrical circuitry 58 may be viewed in the context of the details of the previous Figures. Of course, however, the ECM electrical circuitry 58 may be viewed in the context of any desired environment. Further, the aforementioned definitions may equally apply to the description below.

As shown in FIG. 10, low power ECM electrical circuitry 58 uses another exemplary, non-limiting embodiment of the controlled current source. The controlled current source 59 uses an operational amplifier 60 in a closed loop to bias the jFET 44 and a variable resistor added to resistors Rs1 & Rs2.

It is appreciated that the various microphone circuits shown and described above with reference to FIGS. 1 to 10 may include a buffer transistor (e.g., FET 44) which gate terminal is connected to a first terminal of an capacitive microphone (e.g., ECM 42), which drain terminal is connected via a load network (e.g., load networks 47 and/or 55) to a power source (e.g., battery 18 and/or 56) and to an output terminal, and which source terminal is connected to a regulated current source (e.g., current sources 40, 52, 54, and/or 59). The current source may be connected between the source terminal of the FET and a reference terminal. The reference terminal may be connected to a second terminal of the electret microphone.

The buffer transistor (e.g., FET 44) may have a relatively high drain current at zero bias (Idss), and the current source may force a relatively low drain-source current via the buffer transistor. The current source may be based on a current mirror circuit. The current source comprises a comparator device to set the bias current of the buffer transistor to a pre-defined value.

It is appreciated that the buffer transistor may be selected according to a minimum Length L, and/or a maximum Width W, and/or a large current through the device, and/or a minimum input capacitance.

Figure 11:
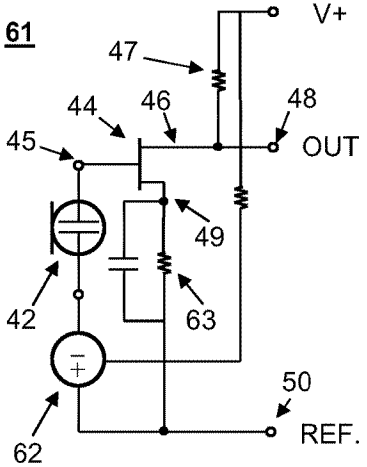
FIG. 11 is a simplified schematic diagram of an ultra-low power ECM electrical circuitry including a controlled voltage supply.

Reference is now made to FIG. 11, which is a simplified schematic diagram of an ultra-low power ECM electrical circuitry 61 including a controlled voltage supply 62, according to one possible embodiment. As an option, the ultra-low power ECM electrical circuitry 61 may be viewed in the context of the details of the previous Figures. Of course, however, the ultra-low power ECM electrical circuitry 61 may be viewed in the context of any desired environment. Further, the aforementioned definitions may equally apply to the description below.

As shown in FIG. 11, the ultra-low power ECM electrical circuitry 61 may include a Field Effect Transistor (FET) 44 (such as the jFET of any of the previous Figs.). The gate terminal 45 of the FET 44 may be connected to a first terminal of an electret condenser microphone 42. The drain terminal 46 of the FET 44 may be connected via a load network 47 to a power source designated as V+. The drain terminal 46 of the FET 44 may be connected also to an output terminal 48. The source terminal 49 of the FET 44 may be connected via a bias network 63 to a reference terminal 50. The second terminal of the electret condenser microphone 42 may be connected via the controlled voltage supply 62 to the reference terminal 50.

It is appreciated that the FET 44 may have a relatively high drain current at zero bias (Idss), and the controlled (regulated) voltage supply 62 may force a negative voltage at the gate terminal of the FET, relative to the source terminal of the FET. Thus providing a relatively high SNR at a relatively low power consumption.

Figure 12:
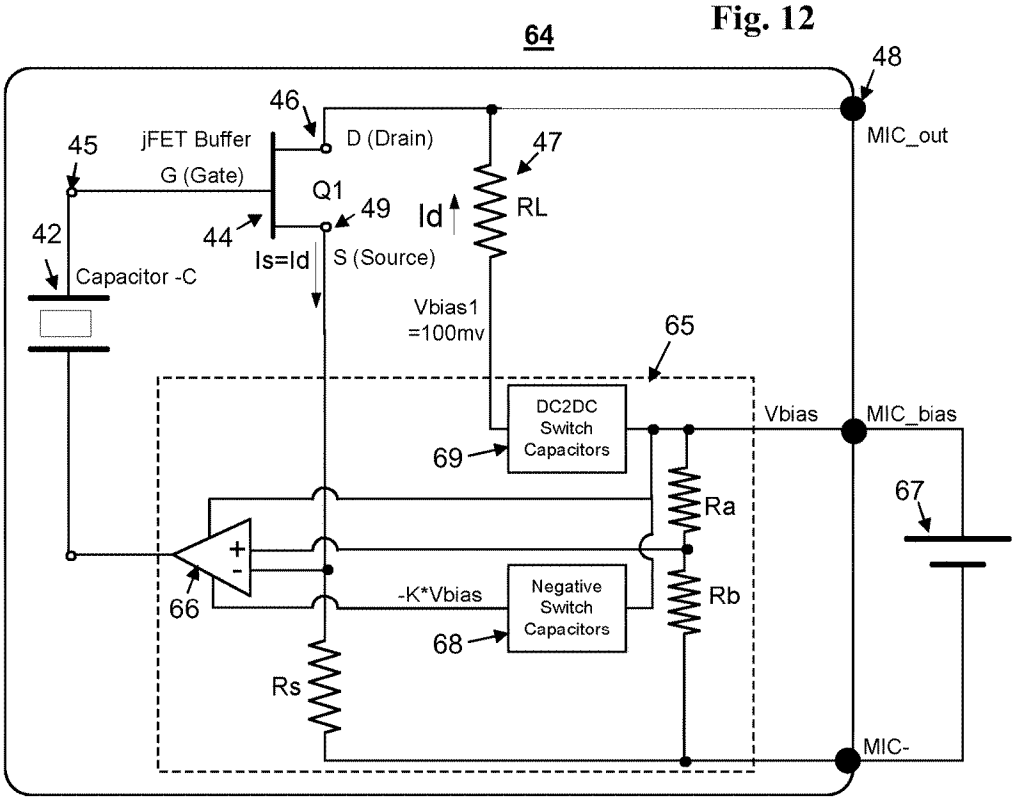
FIG. 12 is a simplified schematic diagram of an ultra-low power ECM electrical circuitry including a detailed controlled voltage supply.

Reference is now made to FIG. 12, which is a simplified schematic diagram of an ultra-low power ECM electrical circuitry 64 including a detailed controlled voltage supply 65, according to one possible embodiment. As an option, the ultra-low power ECM electrical circuitry 64 may be viewed in the context of the details of the previous Figures. Of course, however, the ultra-low power ECM electrical circuitry 64 may be viewed in the context of any desired environment. Further, the aforementioned definitions may equally apply to the description below.

As shown in FIG. 12, the ultra-low power ECM electrical circuitry 64 is one exemplary embodiment of the ultra-low power ECM electrical circuitry 61 of FIG. 11. Similarly, the ultra-low power ECM electrical circuitry 64 may include a Field Effect Transistor (FET) 44 (such as the jFET of any of the previous Figs.). The gate terminal 45 of the FET 44 may be connected to a first terminal of an electret condenser microphone 42. The drain terminal 46 of the FET 44 may be connected via load network 47 to controlled voltage supply 65. The drain terminal 46 of the FET 44 may be connected also to an output terminal 48. The source terminal 49 of the FET 44 may be connected to controlled voltage supply 65. The second terminal of the electret condenser microphone 42 may be connected controlled voltage supply 65 too.

Controlled voltage supply 65 may include an operational amplifier 66 powered by a power source such as battery 67 and a negative power supply 68 in case of n channel FET or positive power supply in case of p channel FET. One input of the operational amplifier 66 is connected to a voltage divider such as resistors Ra and Rb. The other input of the operational amplifier 66 is connected to the source terminal of FET 44 and to a current sensing network such as resistor Rs, which is used to sense the current Id. The output of the operational amplifier 66 is connected to the second terminal of the electret condenser microphone 42. Controlled voltage supply 65 may include power supply 69 connected to drain terminal 46 of the FET 44 via load network 47.

The ultra-low power ECM electrical circuitry 64 operates the jFET buffer in the saturation region by supplying the required Vbias1, which is typically about 100 mV.

As $$g_m = \frac{2}{Vp}\sqrt{I_{dss}I_d},$$

and in saturation the gain of the FET 44 is $g_m R_L$, and therefore $R_L$ remains as in its usual values of 1 kOhm-10 kOhm, and therefore, according to equation 23.

$$V_{ds_min} = \qquad \text{Eq. 23}$$

$$Vgs - Vp = \sqrt{\frac{I_{d_new}Vp^2}{MIdss}}\ I_{d_new} = \frac{1}{M}|Vp| = \sim 3/100 = 30\ \text{mV}$$

Therefore, for Id=5 μA, the voltage over both RL & Rs is about 10 mV. Thus, a minimum supply voltage of 50 mV is required. Therefore, setting Vbias1 to about 100 mV ensures that Q1 is in saturation, all previous equations hold, and Q1 acts like a buffer/amplifier. A negative Vgs decreases the term Vgs−Vp. To do that, we have a block that generates −K*Vbias, used as a negative operating voltage to the operational amplifier 52. The parameter K may be 1 to 3 to generate −3V to −4.5V, assuming supply voltage 53 of 1.5 v-3 v. This negative voltage feeds the negative supply terminal of the operational amplifier 66, while the positive supply terminal of the operational amplifier 66 is connected to Vbias or to zero.

The bias current is sampled by Rs=2.2 k where the 5 μA current provides about 11 mV. Therefore, Ra & Rb set the "+" terminal of the operational amplifier 66 to 11 mv. Ra is selected in the range of 20 MOhm, and Rb is calculated such that V+=11 mV.

It appreciated that it is possible to work with higher voltages, and this is demonstrated by FIG. 12. A current of Is=Id<5 μA may increase Vgs. In other words, Vgs−Vp is increased and Id is increased if the current is greater than 5 μA, then the op output goes negative and Vgs−Vp decreases.

This solution assumes a 32 kHz oscillator used for the switch down DC2DC and for the negative −3V to −4.5V. For 32 kHz and 1 pF switch capacitance, Icc switch=0.04 μA produces about 10 switches. This means that the current consumption of the switches is 0.4 μA. Assuming that the oscillator consumes 0.15 μA, and that the microphone Vbias1 leads to 0.3 μA (from the 1.5V). This means that the total microphone consumption is 0.3 μA+0.4 μA+0.15 μA+0.075 μA=0.925 μA from a 1.5V battery.

It is appreciated that, using switches of 100 fF=0.1 pF, a 32 kHz switching oscillator, and 10 switches, the current may be I=0.048 ua and assuming 50 mv for Vbias1 we get Id=5 ua/30=0.166 μA. Further assuming an operational amplifier consuming 0.01 μA, and the oscillator consuming 0.15 μA, the total current consumption may be 0.166 μA+0.15 μA+0.048 μA+0.05 μA+0.01 μA=0.374 μA from a battery of 1.5V.

This is the lowest power consumption microphone ever made. This microphone still has the same SNR, gain performance using a regular microphone. This microphone device includes three terminals: MIC out (designated by numeral 48), MIC—which is used as ground, and MIC bias which is used as 1.5 v supply. Increasing the bias voltage would increase Id and therefore increases SNR.

It is appreciated that the ultra-low power ECM electrical circuitry 64 may work with any type of capacitor microphone, where, for example, a network of biased capacitor microphone is connected instead of the electret capacitor 42.

Figure 13:
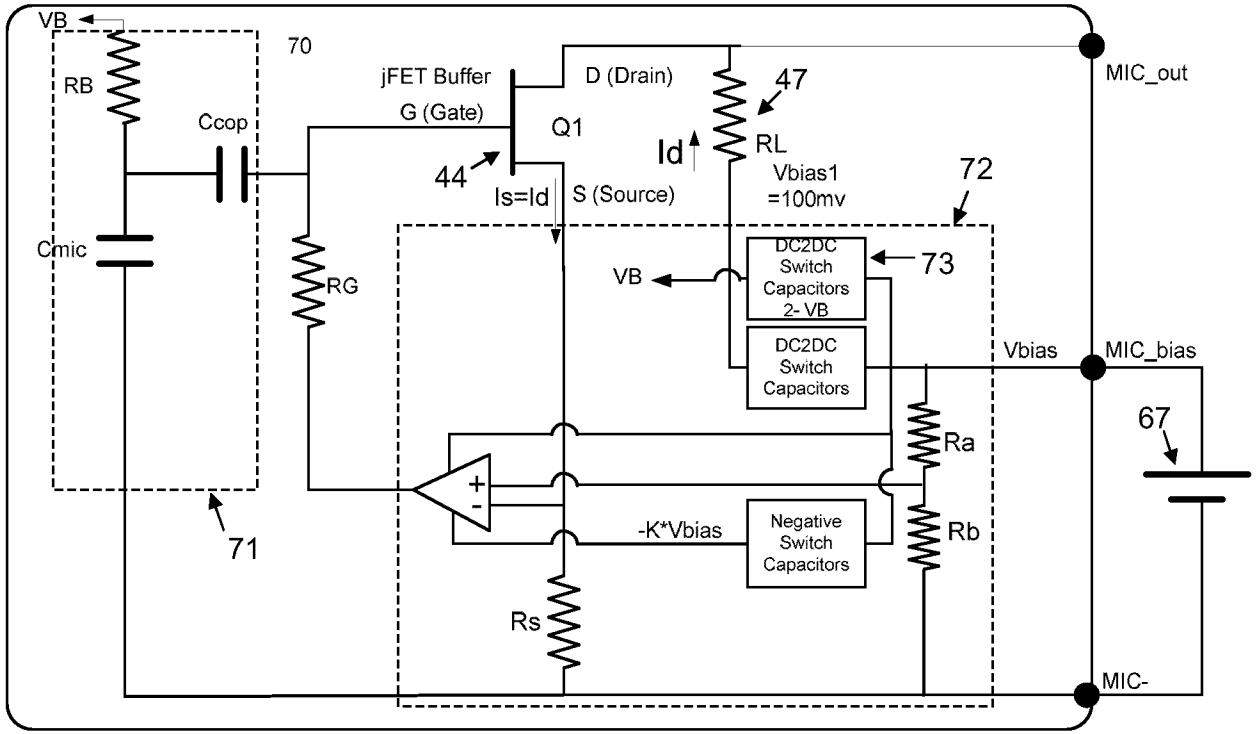
FIG. 13 is a simplified schematic diagram of capacitive microphone electrical circuitry.

Reference is now made to FIG. 13, which is a simplified schematic diagram of capacitive microphone electrical circuitry 70, according to one possible embodiment. As an option, the capacitive microphone electrical circuitry 70 may be viewed in the context of the details of the previous Figures. Of course, however, the capacitive microphone electrical circuitry 70 may be viewed in the context of any desired environment. Further, the aforementioned definitions may equally apply to the description below.

As shown in FIG. 13, the capacitive microphone electrical circuitry 70 is similar to the ultra-low power ECM electrical circuitry 64 of FIG. 12. However, capacitive microphone electrical circuitry 70 includes a capacitive microphone network 71 instead of the electret microphone 28 of FIG. 12. A circuit such as capacitive microphone network 71 is widely used in Micro Electro Mechanical System (MEMS) microphones. Still, to get the lower power consumption, the FET receives a negative supply bias through resistor RG.

Additionally, power supply circuit 72 may include an additional DC-to-DC block 73, which may be implemented using a switch capacitor technology as shown and described herein. DC-to-DC block 73 may generate operating voltage VB for the capacitive microphone of capacitive microphone network 71.

It is appreciated that the various microphone circuits shown and described above with reference to FIGS. 1 to 12, and 13 and particularly FIGS. 11, 12, and 13 may include a buffer transistor (e.g., FET 44) which gate terminal may be connected to a first terminal of a capacitive microphone (e.g., ECM 42), or to a coupling capacitor Ccop of FIG. 13. The drain terminal of the buffer transistor (44) may be connected via a load network (e.g., load network 47) to a power source (e.g., battery 67) and to an output terminal. The source terminal of the buffer transistor may be connected via a resistor to a reference terminal. A regulated voltage source (e.g., voltage source 62 of FIG. 11, and/or voltage source 65 of FIG. 12, and/or voltage source 72 of FIG. 13) may be connected between a second terminal of the electret microphone and the reference terminal. The buffer transistor may have a relatively high drain current at zero bias (Idss), and the regulated voltage source may force a negative voltage at the gate terminal of the FET in the case of an n-channel FET, or positive voltage in the case of a p-channel FET, relative to the source terminal of the FET. The power source (72) may include a comparator device for determining operating point of the buffer transistor (44). The power source (72) may also include DC-to-DC block 73 for the capacitive microphone of capacitive microphone network 71 as shown in FIG. 13.

Figure 14B:
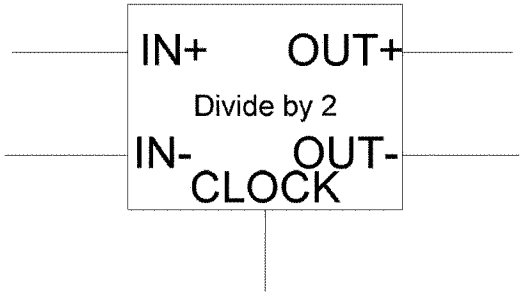
FIG. 14B is a simplified symbolic representation of the DC-to-DC divider.
Figure 14A:
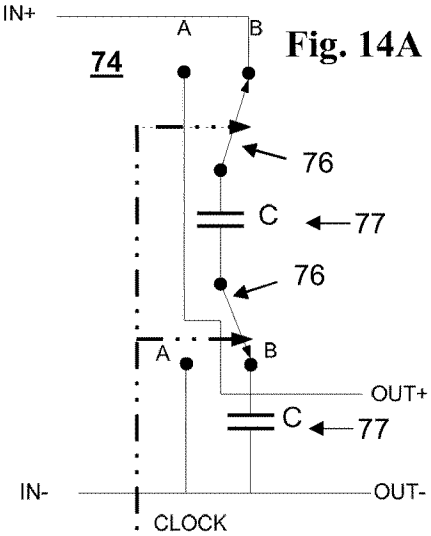
FIG. 14A is a simplified electric schematic diagram of a DC-to-DC divider circuit.
Figure 14C:
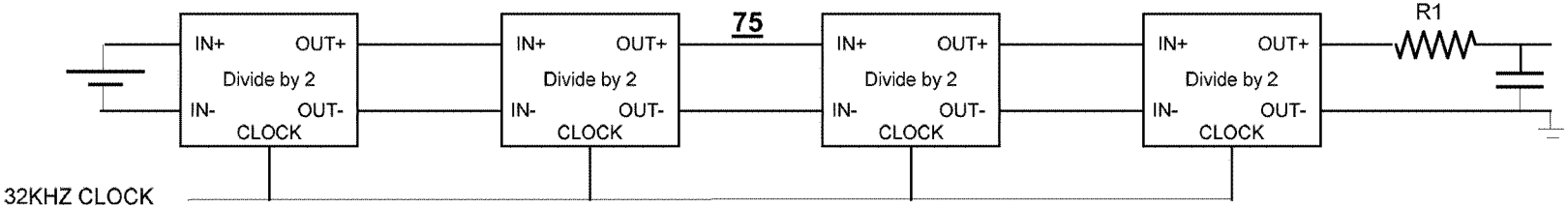
FIG. 14C is a simplified electric schematic diagram of a DC-to-DC voltage supply.

Reference is now made to FIG. 14A, which is a simplified electric schematic diagram of a DC-to-DC divider circuit 74, to FIG. 14B, which is a simplified symbolic representation of the DC-to-DC divider 74, and to FIG. 14C, which is a simplified electric schematic diagram of a DC-to-DC voltage supply 75, according to one possible embodiment. As an option, the DC-to-DC divider 74 and/or the DC-to-DC voltage supply 75 may be viewed in the context of the details of the previous Figures. Of course, however, DC-to-DC divider 74 and/or the DC-to-DC voltage supply 75 may be viewed in the context of any desired environment. Further, the aforementioned definitions may equally apply to the description below.

DC-to-DC divider circuit 74 shown in FIG. 14A is a switching capacitor circuit dividing by 2. DC-to-DC divider circuit 74 includes two switches 76 and two capacitors 77. On the first half of the clock cycle, both switches 76 are in position B, charging the capacitors pair to the input voltage Vin. On the next half of the clock cycle, both switches are on position A, each capacitor has half the charged voltage, namely VIN/2, and the capacitors are connected in parallel. FIG. 14B shows a circuit including four stages of the DC-to-DC divider circuit 74 shown in FIG. 14A, connected in series, and providing an extremely efficient DC-to-DC converter.

Small area switches with extremely low Vgs, and Rds=1000Ω with C=1 nF for last stage give a ripple of 8 mV for a current of 5 μA. Assuming R1=1KΩ (this is much lower than Rload=0.9375/5 μA). If the Vbias1 is implemented on a chip, C1 is an external capacitor with a value of 1.5 μF. This will make a ripple of 26 μV.

Figure 15:
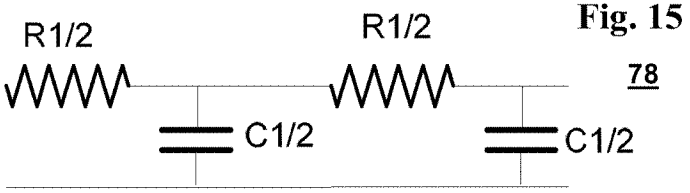
FIG. 15 is a simplified schematic diagram of an output filter electrical circuitry.

Reference is now made to FIG. 15, which is a simplified schematic diagram of an output filter electrical circuitry 78, according to one possible embodiment. As an option, the output filter electrical circuitry 78 may be viewed in the context of the details of the previous Figures. Of course, however, the output filter 78 may be viewed in the context of any desired environment. Further, the aforementioned definitions may equally apply to the description below.

Output filter electrical circuitry 78 may be added at the output of DC-to-DC voltage supply 75 for additional filtering of the output supply voltage. As shown in FIG. 15, output filter electrical circuitry 78 may include two resistors of half the value of R1 of FIG. 14C, and two capacitors. For example, output filter electrical circuitry 78 using R1/2=500Ω and C1/2=0.7 μF produces a ripple of 8 mV 0.03 μV, which is much below the microphone noise.

The last stage may include capacitors of 1000 pF, which may be implemented on a chip. On discharge the circuit produces output voltage of 5 μA/1000 pF*16e-6=8 mV, thus requiring 16 mV to charge both capacitors. Therefore, the power consumed by the switches is given by equation 24:

$$P_{switche_resistors_charge} = \frac{C/2}{2T}\Delta^2 = \frac{500pf}{31.25\ u\ \sec}(16\ mv)^2 = 4.1\ nWatt \quad \text{Eq. 24}$$

And the discharge power is given by equation 25.

$$P_{switche_resistors_discharge} \approx (5\ \text{ua}/2)^2 1000 = 6\ \text{nWatt} \quad \text{Eq. 25}$$

The third stage may have a half current of 5 μA, which means that even for smaller capacitors the power may be halved during charging, and even less for during discharge. For example consuming 20 nWatt to 30 nWatts, compared to 5 μA*0.1V=500 nWatts. Therefore yielding efficiency of 500/530*100=94.

Figure 16:
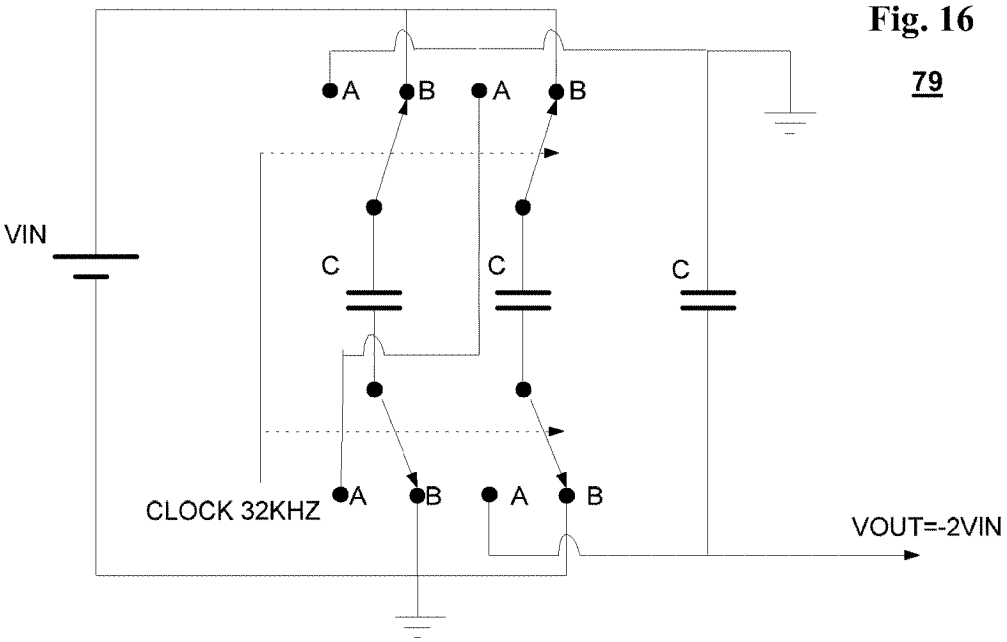
FIG. 16 is a simplified schematic diagram of a negative voltage supply electrical circuitry.

Reference is now made to FIG. 16, which is a simplified schematic diagram of a negative voltage supply electrical circuitry 79, according to one possible embodiment. As an option, the negative voltage supply 79 may be viewed in the context of the details of the previous Figures. Of course, however, the negative voltage supply 79 may be viewed in the context of any desired environment. Further, the aforementioned definitions may equally apply to the description below.

The negative voltage supply 79 may be used with a slow operational amplifier. An operational amplifier and/or comparator consuming about 10 nA-50 nA may be operated with a negative voltage supply 79 using small capacitors and operating at high efficiency. For example, a negative voltage supply 79 using C=10 pF capacitors and providing I=50 na the ripple voltage would be about 8 mV, which could be reduced if needed (power supply still has power supply rejection) using, for example, the filter 78 of FIG. 15.

Figure 17:
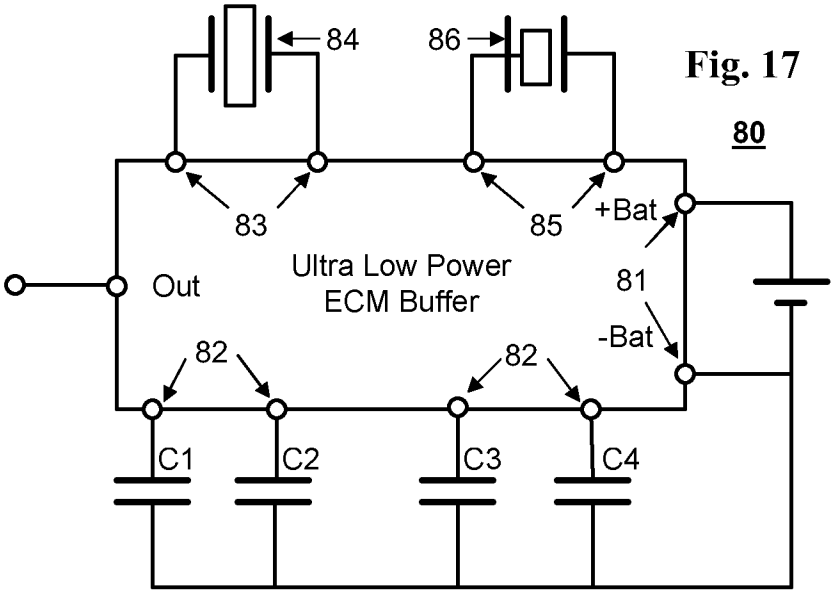
FIG. 17 is a simplified schematic diagram of an ECM buffer integrated circuit.

Reference is now made to FIG. 17, which is a simplified schematic diagram of an ECM buffer integrated circuit (IC) 80, according to one possible embodiment. As an option, the ECM buffer IC 80 may be viewed in the context of the details of the previous Figures. Of course, however, the ECM buffer integrated circuit 80 may be viewed in the context of any desired environment. Further, the aforementioned definitions may equally apply to the description below.

As shown in FIG. 17, the ECM buffer IC 80 may include two terminals 81 for the supply voltage, four terminals 82 for four capacitors used to reduce the ripple on the generated negative voltage and low operating voltage, two pins 83 for a crystal 84, such as a the 32 Khz crystal, and two pins 85 for the electret condenser microphone 86.

It is appreciated that the only sources for the power consumption are the 5 μA from 1.5/16 V (Vbias1 generated by dividing 1.5V by 16). Thus, the consumption from the 1.5 v would be 5/16=0.3125 μA. If, for example, the step-down DC-to-DC 75 of FIG. 14C has five stages, then the current consumption from the 1.5V battery may be 5/32=0.156 μA. The Vbias1 and the negative voltage supply would not consume nearly any power. Therefore the only other consumers are the operational amplifier with 10 nA-50 nA and the 32 kHz crystal oscillator with a 0.15-0.2 μA. Therefore the ECM may be working on full span with a current consumption of about 0.3 μA-0.5 μA.

It is therefore appreciated that the circuits and methods described above enable an ultra-low power microphone circuitry, operating from 20 Hz to 20 kHz, with a current consumption of about 0.3 μA-0.5 μA. Compared with commonly used microphones consuming about 500 μA, the circuits and methods described above provides a thousand-fold improvement in power efficiency over commonly used microphones, and about 80 to 100 better than the lowest power consumption microphone known today.

It is also appreciated that the power consumed by the circuits and methods described above the power consumption can be further reduces by using sample-and-hold circuitry and turning the sampling circuitry off between sample.

Figure 18:
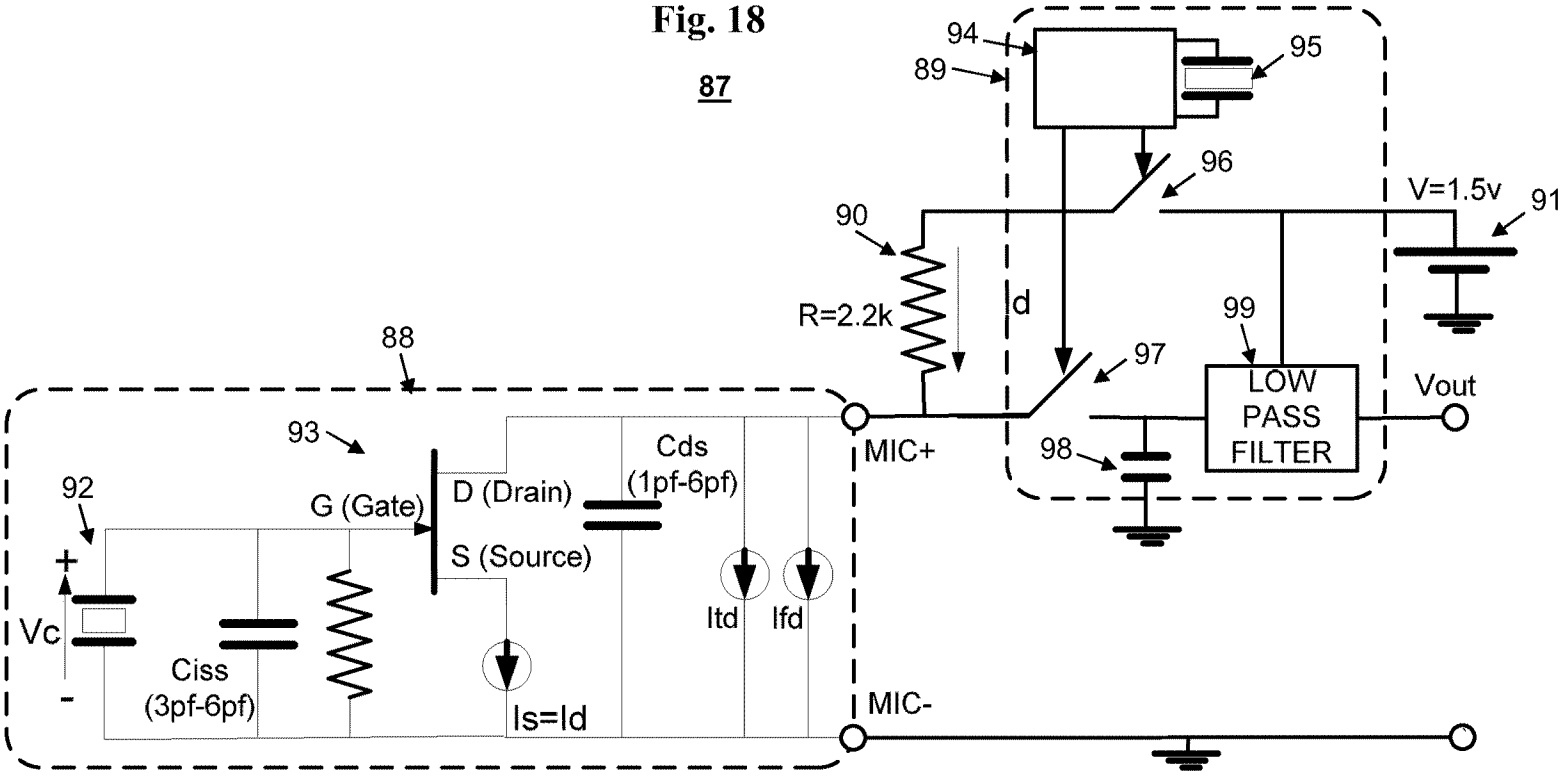
FIG. 18 is a simplified schematic diagram of an ECM sample-and-hold circuit.

Reference is now made to FIG. 18, which is a simplified schematic diagram of an ECM sample-and-hold circuit 87, according to one possible embodiment. As an option, the ECM sample-and-hold circuit 87 may be viewed in the context of the details of the previous Figures. Of course, however, the ECM sample-and-hold circuit 87 may be viewed in the context of any desired environment. Further, the aforementioned definitions may equally apply to the description below.

As shown in FIG. 18, the ECM sample-and-hold circuit 87 may include an ECM circuit 88, a sample-and-hold circuit 89, connected via a load network 90, and powered by a power supply 91. The ECM circuit 88 may include an ECM 92 and an ECM buffer circuit 93 and optionally an output filter, with a power supply as such as shown and described above. Particularly, the ECM buffer circuit 93 may use any of the circuits shown and described above with reference to FIGS. 1, 2, 5, 6, 7, 8, 9, 10, 11, and 12, as well as FIG. 13.

The sample-and-hold circuit 89 includes a clock 94 with a crystal oscillator 95. The clock 94 controls the ON/OFF operation of a power switch 96 and a sampling switch 97. The output signal of the ECM circuit 88 is sampled by capacitor 98 and filtered by low-pass-filter 99. Power switch 96 connects and disconnects the power supply to the ECM circuit 88 in synchronization with the sampling operation of sampling switch 97.

According to one possible embodiment the microphone power is switched on for a short time such as 100 nsec with a sampling frequency of 64 kHz (Tcycle=~16 μsec). Therefore the reducing a typical power consumption of 500 μA to about 3 μA according to 500 μA*0.1 μsec/16 μsec=~3 μA The microphone on/off switch, sample-and-hold and the low-pass filter consume extremely low power such as 1 μA-15 μA.

The 3 μA consumption could be further reduced by using a higher Idss with a control of Vgs as disclosed above.

Figure 19:
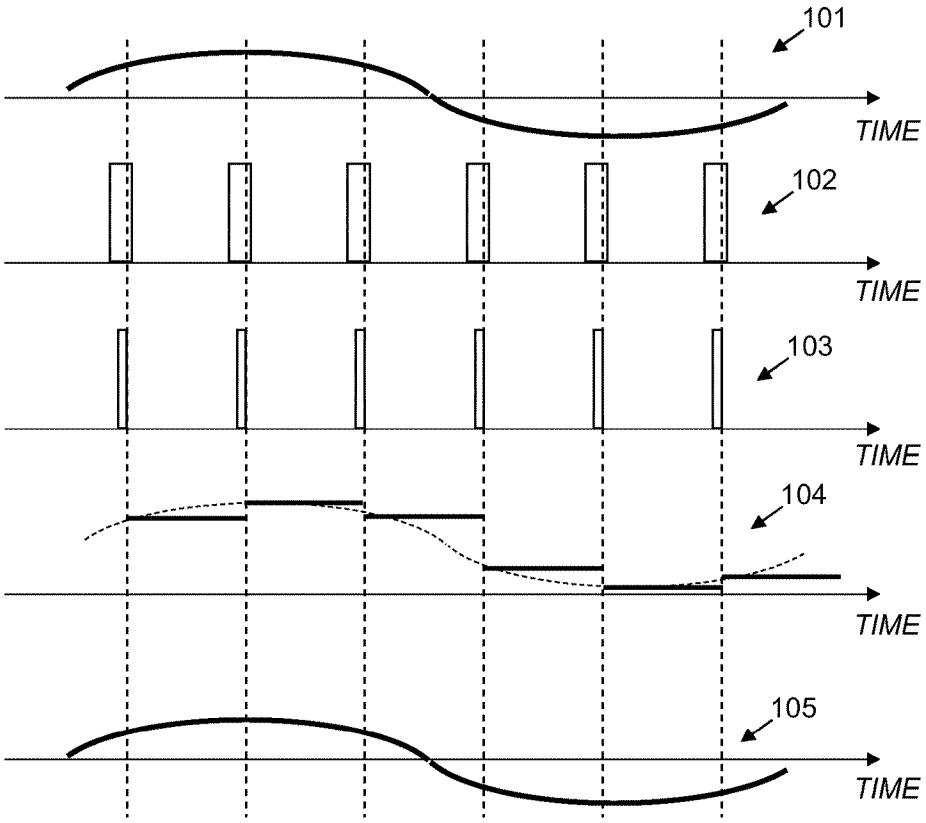
FIG. 19 is a simplified timing diagram representing the operation of the ECM sample-and-hold circuit of FIG. 18.

Reference is now made to FIG. 19, which is a simplified timing diagram 100 representing the operation of the ECM sample-and-hold circuit 87 of FIG. 18, according to one possible embodiment. As an option, the timing diagram 100 may be viewed in the context of the details of the previous Figures. Of course, however, the timing diagram 100 may be viewed in the context of any desired environment. Further, the aforementioned definitions may equally apply to the description below.

The timing diagram 100 shows a signal 101 produced by the ECM sample-and-hold circuit 87 of FIG. 18 at the input of the sample-and-hold circuit 89 (e.g., MIC+). The timing diagram 100 also shows power ON/OFF 102 as provided by Power switch 96 of FIG. 18. The timing diagram 100 also shows sampling ON/OFF 103 as executed by sampling switch 97 of FIG. 18. The timing diagram 100 also shows sampled signal 104 as provided by sampling switch 97 to the low-pass-filter 99 of FIG. 18. Finally, the timing diagram 100 shows the output signal 105 as provided at the output of the low-pass-filter 99 of FIG. 18.

The signal in FIG. 19 represents a continues signal if microphone is switched on all the time. The pulses from the drain represents the output from the drain of the jFET due to the on/off switching of the power supply of the microphone. After switching the microphone to on, and after some setup time the signal is sampled using the sample clock. Filtering this signal recovers the original signal. As seen from FIG. 19, the pulses from the drain have a higher voltage swing, due to the fact that usually a microphone signal is low. However, output DC is about 1 v, so this will generate some distortion which could be eliminated using the circuit 107 of FIG. 20.

Figure 20:
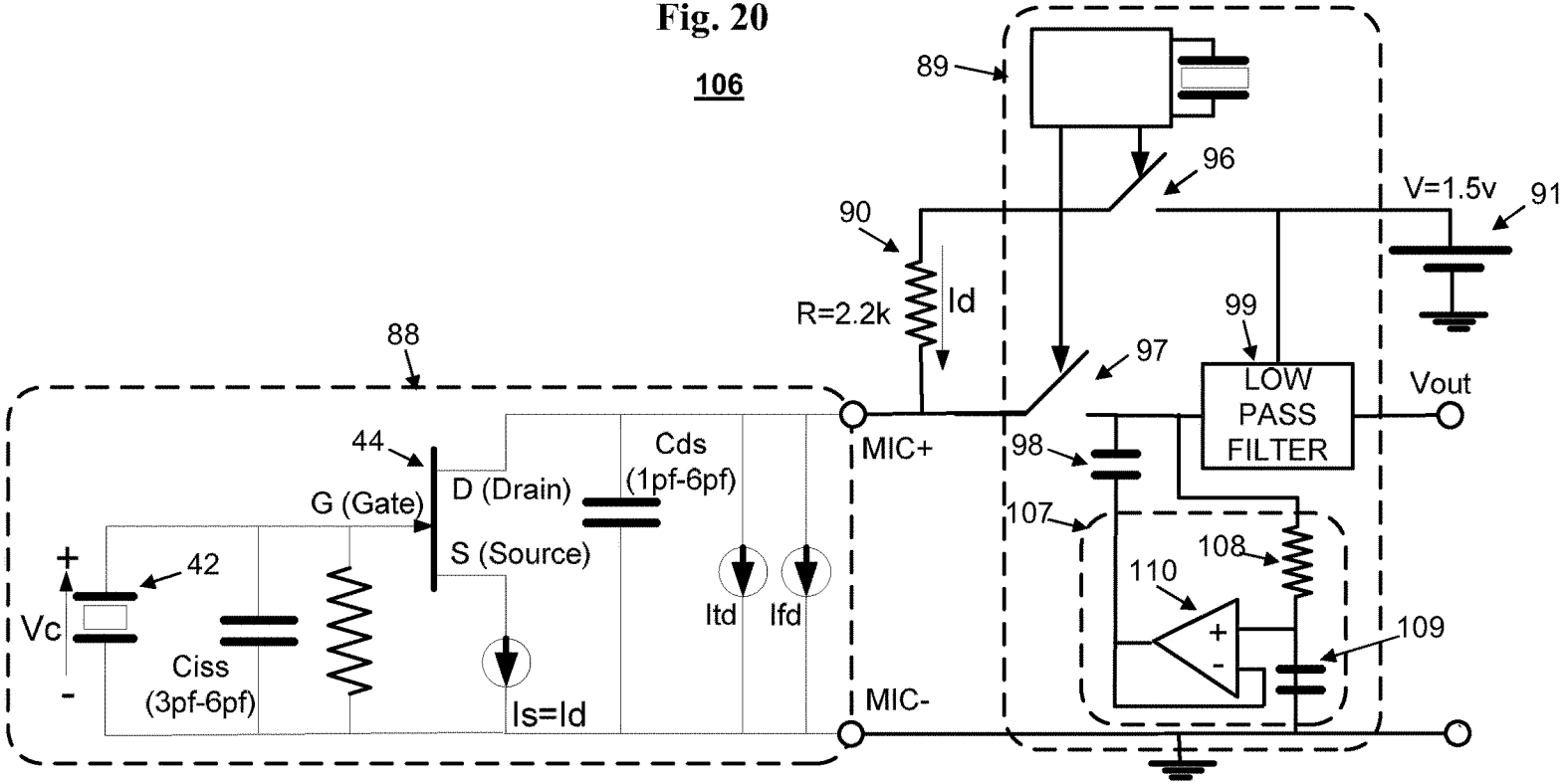
FIG. 20 is a simplified schematic diagram of a biased ECM sample-and-hold circuit.

Reference is now made to FIG. 20, which is a simplified schematic diagram of a biased ECM sample-and-hold circuit 106, according to one possible embodiment. As an option, the biased ECM sample-and-hold circuit 106 may be viewed in the context of the details of the previous Figures. Of course, however, the biased ECM sample-and-hold circuit 106 may be viewed in the context of any desired environment. Further, the aforementioned definitions may equally apply to the description below.

The biased ECM sample-and-hold circuit 106 is similar to the sample-and-hold circuit 89 of FIG. 18 with the addition of a bias circuit 107. As shown in FIG. 20, a network including a resistor 108 and a capacitor 109 is connected between the input of the low-pass filter 99 and the reference terminal (ground). The point between resistor 108 and capacitor 109 is connected to one input (positive) of an operational amplifier 110. The other input (negative) of operational amplifier 110 is connected to the output of operational amplifier 110, which is connected to the sampling capacitor 98. Thus, the operational amplifier 110 provides a DC bias to the sampling capacitor 98. Therefore, the sampling capacitor 98 is loaded to a small portion of the voltage and the distortion is minimized.

Hence, various combinations of the methods and circuits shown and described herein enable the use of an electret condenser microphone working in the range of 20 Hz to 20 kHz and consuming ultra-low power, with current consumption in the range of 0.3 μA-2 μA.

Decreasing the current Id via the load network (resistor 90) reduces the Signal to Noise Ratio (SNR). The noise voltage variance at the output is given by equation 26:

$$v_n^2 = K_n g_m R^2 \qquad \text{Eq. 26}$$

Where $K_n$ and $g_m$ are defined in equations 8, 9, and 12, and R is the resistance of the load network (resistor 90). The output voltage is given by equation 27:

$$V_{out(ac)}^2 = \left(\left[Q_p \frac{h_p}{h_0 + h_p}\right]\left[\frac{\Delta h_0}{\varepsilon_0 A}\right]\right)^2 \left(\frac{\frac{1}{Ciss}}{\left[\frac{\Delta h_0}{\varepsilon_0 A} + \frac{1}{Ciss}\right]}\right)^2 g_m^2 R^2 \qquad \text{Eq. 27}$$

Where Qp is the permanent polarization charge in electret of ECM 42 and Ciss is the capacitance of the input network to jFET buffer.

Neglecting the thermal noise from the load network (resistor 90), SNR can then be determined using equation 28:

$$SNR = \left(\left[Q_p \frac{h_p}{h_0 + h_p}\right]\left[\frac{\Delta h_0}{\varepsilon_0 A}\right]\right)^2 \left(\frac{\frac{1}{Ciss}}{\left[\frac{\Delta h_0}{\varepsilon_0 A} + \frac{1}{Ciss}\right]}\right)^2 g_m \frac{1}{K_n} == \qquad \text{Eq. 28}$$

-continued $$\frac{1}{K_n}\left(\left[Q_p \frac{h_p}{h_0 + h_p}\right]\left[\frac{\Delta h_0}{\varepsilon_0 A}\right]\right)^2 \left(\frac{\frac{1}{Ciss}}{\left[\frac{\Delta h_0}{\varepsilon_0 A} + \frac{1}{Ciss}\right]}\right)^2 \frac{2}{Vp}\sqrt{I_{dss} I_d}$$

Where Id is the drain current via the load network (resistor 90), and Idss is the drain to source current of jFET.

When the biased ECM sample-and-hold circuit 106 of FIG. 17 or ECM 11 of FIG. 2 use a low supply voltage (V<1.5 v), the jFET 44 of FIG. 17 or jFET 12 of FIG. 2 may work in the ohmic region. It is therefore assumed that the supply voltage Vdd=V<|Vp|. Vdd can be calculated according to equation 29 or 30:

$$V_{dd} = RI_{dss}\left[2\left(1 - \frac{Vgs}{Vp}\right)\left(\frac{Vds}{-p}\right) - \left(\frac{Vds}{Vp}\right)^2\right] + Vds \text{ or} \qquad \text{Eq. 29}$$

$$V_{dd} = K\lfloor 2(Vp - Vgs)Vds + Vds^2 \rfloor + Vds \qquad \text{Eq. 30}$$

$$\text{where } K = -\frac{RI_{dss}}{Vp^2}$$

and Vgs is the input signal plus the Vgs(DC) that may be set to any negative value for n channel FET or any positive value for p channel FET (for example FIG. 10)

Alternatively, according to equation 31 or 32:

$$0 = -2KVds + 2K(Vp - Vgs)\frac{\partial Vds}{\partial Vgs} + 2KVds\frac{\partial Vds}{\partial Vgs} + \frac{\partial Vds}{\partial Vgs} \qquad \text{Eq. 31}$$

$$\frac{\partial Vds}{\partial Vgs} = \frac{2KVds}{2K(Vp - Vgs) + 2KVds + 1} \qquad \text{Eq. 32}$$

It is possible to calculate Vds for a given Vgs using equation 19 and according to equation 33 and 34:

$$KVds^2 + Vds(2K(Vp - Vgs) + 1) - V_{dd} = 0 \qquad \text{Eq. 33}$$

$$Vds = \frac{-(2K(Vp - Vgs) + 1) + \sqrt{(2K(Vp - Vgs) + 1)^2 + 4KV_{dd}}}{2K} \qquad \text{Eq. 34}$$

Combining equations 32 and 34 gives equation 35, which leads to equation 36:

$$\frac{\partial Vds}{\partial Vgs} = \frac{-(2K(Vp - Vgs) + 1) + \sqrt{(2K(Vp - Vgs) + 1)^2 + 4KV_{dd}}}{\sqrt{(2K(Vp - Vgs) + 1)^2 + 4KV_{dd}}} = 1 - \frac{1}{\sqrt{1 + \frac{4KVdd}{(2K(Vp - Vgs) + 1)^2}}} \qquad \text{Eq. 35}$$

$$\psi(K) = \frac{4KVdd}{(2K(Vp - Vgs) + 1)^2} \qquad \text{Eq. 36}$$

Figure 21:
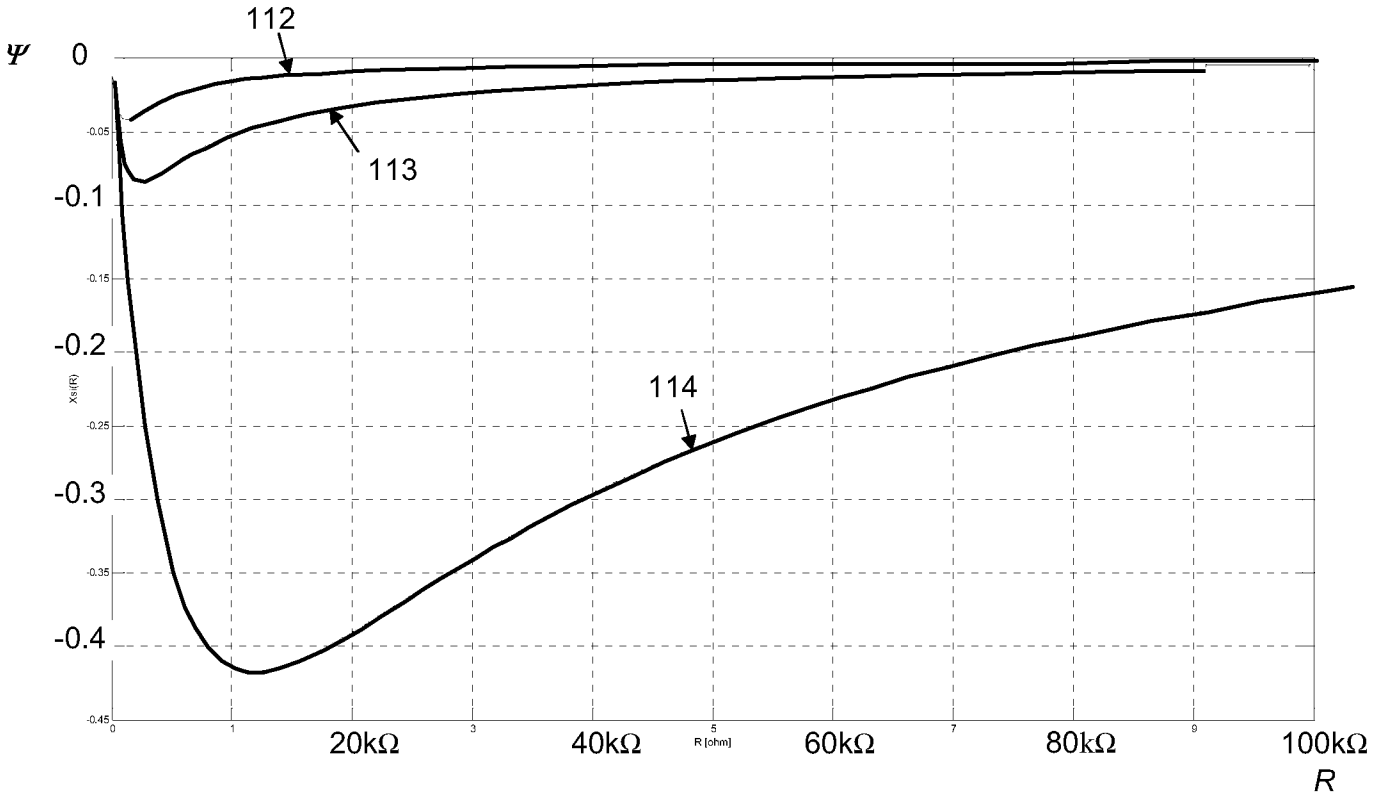
FIG. 21 is a simplified plot representing the value of the function $\Psi(K)$.

Reference is now made to FIG. 21, which is a simplified plot 111 representing the value of the function Ψ(K), according to one possible embodiment. As an option, plot 111 may be viewed in the context of the details of the previous Figures. Of course, however, plot 111 may be viewed in the context of any desired environment. Further, the aforementioned definitions may equally apply to the description below.

FIG. 21 shows $$\psi\left(-\frac{RI_{dss}}{Vp^2}\right)$$

as a function of R for Vdd=0.1V and for three values of Vgs. Plot 112 shows the function Ψ for Vgs=0. Plot 113 shows the function P for Vgs=0.5 Vp, and Plot 114 shows the function Ψ for Vgs=0.9 Vp.

FIG. 21 shows that for Vgs=0.9 Vp, R=12.5 k gives a minimal $$\psi\left(-\frac{RI_{dss}}{Vp^2}\right)$$

value of −0.4167 yielding a gain $$\frac{\partial Vds}{\partial Vgs}$$

of −0.3.

Figure 22:
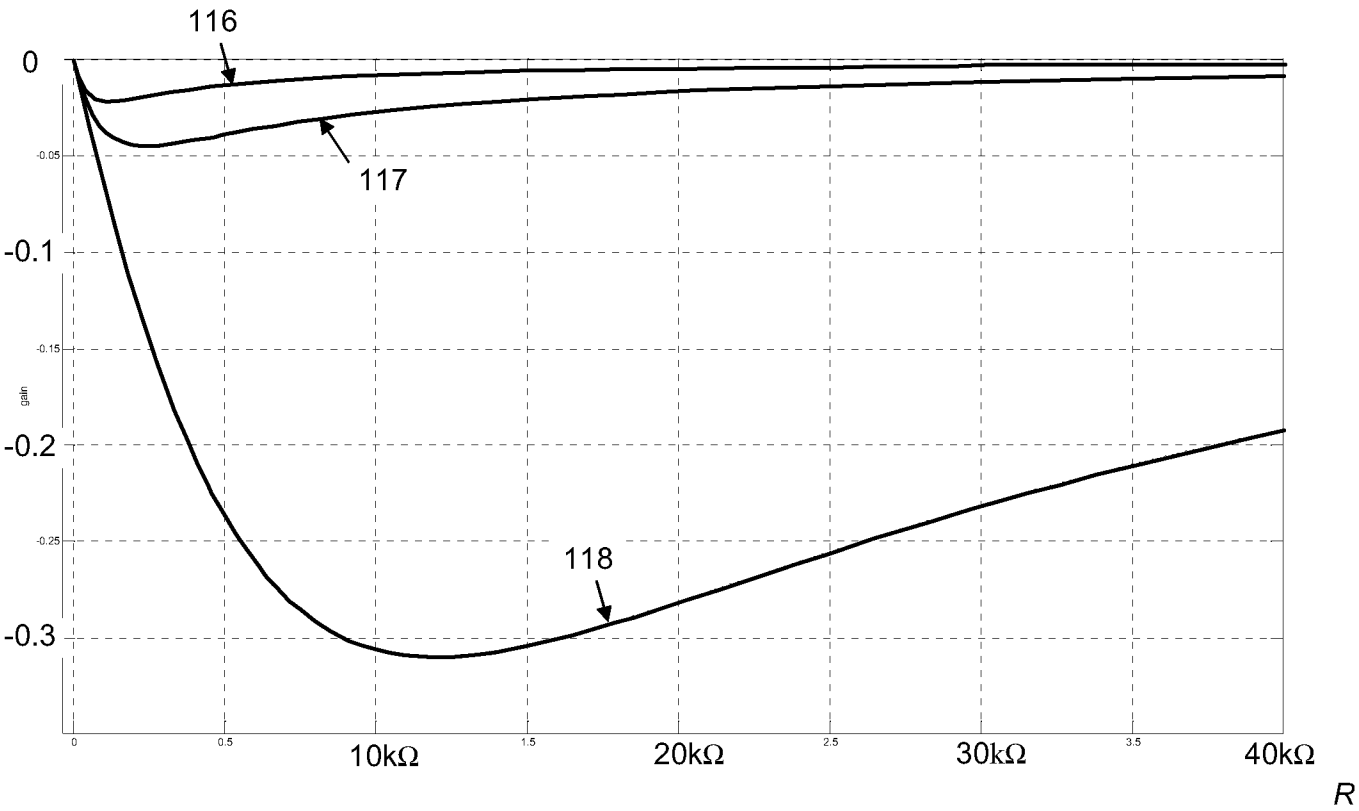
FIG. 22 is a simplified plot 1 representing the value of the gain $\partial Vds/\partial Vgs$.

Reference is now made to FIG. 22, which is a simplified plot 115 representing the value of the gain $$\frac{\partial Vds}{\partial Vgs},$$

according to one possible embodiment. As an option, plot 115 may be viewed in the context of the details of the previous Figures. Of course, however, plot 115 may be viewed in the context of any desired environment. Further, the aforementioned definitions may equally apply to the description below.

FIG. 22 shows the gain $$\frac{\partial Vds}{\partial Vgs}$$

as a function of R for several values of Vgs. Plot 116 shows the gain for Vgs=0. Plot 117 shows the gain Ψ for Vgs=0.5 Vp, and Plot 118 shows the gain for Vgs=0.9 Vp. As may be seen in FIG. 22, for Vgs=0.9 Vp the gain is optimal, with a value of about −0.03, for R=12.5 kΩ.

It is appreciated that it is advantageous that Vdd should have a value that sets so that Vds is lower than Vgs−Vp. Therefore setting Vdd to Vgs−Vp may force the jFET to be in the ohmic region.

The gain then assumes equation 37:

$$\frac{\partial Vds}{\partial Vgs} = 1 - \frac{1}{\sqrt{1 + \frac{4KVdd}{(2K(Vp - Vgs) + 1)^2}}} = 1 - \frac{1}{\sqrt{1 - \frac{4K(Vp - Vgs)}{(2K(Vp - Vgs) + 1)^2}}} = 1 - \frac{1}{\sqrt{1 - \frac{4x}{(2x + 1)^2}}} \quad \text{Eq. 37}$$

where $x = K(Vp - Vgs)$

The extreme value of $$\theta(x) = \frac{4x}{(2x + 1)^2}$$

may be given by equation 38:

$$\frac{\partial \theta(x)}{\partial x} = \frac{4(2x + 1)^2 - 16x(2x + 1)}{(2x + 1)^4} = 0 \Rightarrow -16x^2 + 4 = 0 \Rightarrow = 0.5 \Rightarrow -\frac{RI_{dss}}{Vp^2}(Vp - Vgs) = \frac{1}{2} \Rightarrow R = \frac{Vp^2}{(Vgs - Vp)I_{dss}} \quad \text{Eq. 38}$$

Therefore the gain may be given by equation 39:

$$\frac{\partial Vds}{\partial Vgs_{MAX}} = 1 - \frac{1}{\sqrt{1 - \frac{4x}{(2x + 1)^2}}} = 1 - \frac{1}{\sqrt{1 - \frac{4(0.5)}{(2(0.5) + 1)^2}}} = 1 - \sqrt{2} = -0.4142 \quad \text{Eq. 39}$$

However, providing a lower voltage than Vgs−Vp for Vdd may give lower gain values.

It is appreciated that as long as Vdd=Vgs−Vp the gain may be about −0.4142, independently of the jFET. As the jFET in this region behaves like a resistor the generated noise can be described by equation 40:

$v_n^2 = 4KTR_{ch}\|R\Delta f$, where $R_{ch}$ is the jFET channel resistance. Eq. 40

However, according to equation 41:

$$R_{ch} = \frac{Vds}{Id} = \frac{Vds}{I_{dss}\left[2\left(1 - \frac{Vgs}{Vp}\right)\left(\frac{Vds}{-Vp}\right) - \left(\frac{Vds}{Vp}\right)^2\right]} = \frac{1}{I_{dss}\left[2\left(1 - \frac{Vgs}{Vp}\right)\left(\frac{1}{-Vp}\right) - \left(\frac{1}{Vp}\right)^2 Vds\right]} \approx \approx \frac{-Vp}{2I_{dss}} \frac{1}{\left(1 - \frac{Vgs}{Vp}\right)} = \frac{Vp^2}{2(Vgs - Vp)} = R/2 \quad \text{Eq. 41}$$

Thus, giving equation 42:

$$v_n^2 = 4KTR_{ch} \| R\Delta f = 4KT\Delta f \frac{Vp^2}{3(Vgs - Vp)I_{dss}} \quad \text{Eq. 42}$$

For a constant gain of, for example −0.4142, the SNR is relative to $1/v_n^2$, and therefore according to equation 43:

$$SNR \propto \frac{3(Vgs - Vp)I_{dss}}{Vp^2} \quad \text{Eq. 43}$$

It is therefore possible to select a jFET with a large Idss to compensate for the decrease of Vgs−Vp.

A commonly used ECM would generally have a jFET with an Idss=0.5 ma and with Vp=−1 v. This means that an electric circuit with Vdd=1 v would force the jFET to be in the ohmic region, and would give a gain of −0.4142 (neglecting the attenuation due to Ciss which is $$\left[\frac{1}{\left(1 + \frac{Ciss}{C}\right)^2}\right])$$

in the case of capacitor microphones (such as shown and described with reference to FIG. 13, where C=Cmic of FIG. 13)

Thus, decreasing the value of Vgs−Vp by M (such as M=100), and using a jFET with Idss which is M times greater than the 0.5 ma, may give the same SNR performance.

Returning to FIG. 12, it is appreciated that that it is possible to decrease the Vdd and still keep a gain of −0.4142, as long as Vdd=Vgs−Vp. Decreasing Vdd, decreases the power consumption of the ECM buffer circuit. This requires a jFET with an increased Idss to compensate for the decrease of Vgs−Vp (keeping a low Ciss).

The power consumption of the circuit of above microphone FIG. 12 is given by equation 44:

$$P = \frac{(Vgs - Vp)^2}{\left[\frac{3}{2}\frac{Vp^2}{(Vgs - Vp)Idss}\right]} = \frac{2(Vgs - Vp)^3 I_{dss}}{3Vp^2} = \frac{2}{3}(Vgs - Vp)\frac{1}{M^2}MI_{dss_old} = \frac{2}{3}Vp\frac{1}{M^2}I_{dss_old} = \approx \frac{1}{M^2}\left[\frac{2}{3}VpI_{dss_old}\right] \text{ where } 1/M = \frac{(Vgs - Vp)}{Vp} \quad \text{Eq. 44}$$

The expression $$\frac{1}{M^2}\left[\frac{2}{3}VpI_{dss_old}\right]$$

shows that the power is reduced by $M^2$. Thus, reducing the current (with a reference to Vp) by $M^2$ to about 0.5 μA, for example, by using $M=\sqrt{1000}=31.6$. Therefore, Vgs−Vp=Vp/M≈1/31.6=31.6 mV requiring a jFET having Idss=15.8 mA (=31.6×0.5 ma) with Ciss=3 pF and Vp=−1V.

Returning to FIG. 12 together with FIGS. 14A, 14 and 14C, using Vbias1=46 mV (which is close to the required 31.6 mv), the current from the power supply may be about 15 μA, which may be provided by a 1.2-1.5 v battery.

Thus, assuming small switches with extremely small Vgs, Rds=1000 Ohm, and C=1 nF for the last stage the ripple voltage may be about 8 mV for a current consumption of about 5 μA. Assuming R1=300 Ohm (which is much lower than Rload=0.046/15 μA), the Vbias1 is implemented on a chip, where C1 is an external capacitor with a value of 0.15 uF. Therefore setting the ripple to about 26 uV.

The output filter electrical circuitry 78 of FIG. 15 can be used for additional filtering. Using C1/2=50 nf and R1/2=5000 ohm an input ripple of 8 mV produces output ripple of about 0.03 μV, which is much below the microphone noise.

The last stage may use, for example 1000 pF capacitors, which can be implemented in a chip. On discharge, a current of 5 μA produces 5 ua/1000 pf*16e-6=8 mv. Therefore requiring 16 mV for charging both capacitors. The power consumed by the switches is therefore given by equations 45 (charge) and 46 (discharge):

$$P_{switche_resistors_charge} = \frac{C/2}{2T}\Delta^2 = \frac{500 \text{ pF}}{31.25\ usec}(16 \text{ mV})^2 = 4.1\ nWatt \quad \text{Eq. 45}$$

$$P_{switche_resistors_discharge} \approx (5\ ua/2)^2 1000 = 6\ nwatt \quad \text{Eq. 46}$$

The third stage may have a current which is half the 5 μA value. Therefore, using smaller capacitors the charging power consumption may be reduced (e.g., halved), and similarly for the discharging. A rough estimation is 20 nWatt to 30 nWatt, compared with 5 μA×0.1V=500 nWatt. Therefore yielding efficiency of (500/530)×100=94%.

Returning to FIG. 16, using an operation amplifier/comparator consuming about 50 nA and extremely small capacitors, a higher efficiency can be obtained. For example, using C=10 pF capacitors, I=50 nA, a ripple of 8 mV is produced, which may be further reduced using the output filter electrical circuitry 78 of FIG. 15.

Returning to FIG. 16, the electric circuits described above may be used in two modes. In a first mode the ECM circuitry is used with Vdd<Vgs−Vp, for example, Vdd=α(Vgs−Vp)) and therefore according to equation 47:

$$\frac{\partial Vds}{\partial Vgs} = 1 - \frac{1}{\sqrt{1 + \frac{4KVdd}{(2K(Vp - Vgs) + 1)^2}}} = 1 - \frac{1}{\sqrt{1 - \frac{4K\alpha(Vp - Vgs)}{(2K(Vp - Vgs) + 1)^2}}} == 1 - \frac{1}{\sqrt{1 - \frac{4\alpha x}{(2x + 1)^2}}} \quad \text{Eq. 47}$$

where $x = K(Vp - Vgs)$, $0 < \alpha \leq 1$

Therefore the value of Θ(x) is given by equation 48:

$$\theta(x) = \frac{4\alpha x}{(2x + 1)^2}, \quad \text{Eq. 48}$$

therefore the derivative is given by equation 49:

$$\frac{\partial\theta(x)}{\partial x}=\frac{4\alpha(2x+1)^2-16\alpha x(2x+1)}{(2x+1)^2}=0\Rightarrow 16\alpha x^2=4\alpha\Rightarrow x=0.5 \quad \text{Eq. 49}$$

Leading to equation 50:

$$\frac{\partial Vds}{\partial Vgs}==1-\frac{1}{\sqrt{1-\frac{4\alpha x}{(2x+1)^2}}}= \quad \text{Eq. 50}$$

$$1-\frac{1}{\sqrt{1-\frac{4\alpha(0.5)}{(2(0.5)+1)^2}}}=1-\frac{1}{\sqrt{1-0.5\alpha}}\approx\approx$$

$$-(1+0.5/2\alpha)=-\alpha 0.25=-0.25\frac{Vdd}{Vgs-Vp}$$

This mode is useful for a regular ECM (Vgs=0) and a low Vdd, which is lower than |Vp|. For a regular ECM (Vgs=0), and the gain may be given by equation 51:

$$\frac{\partial Vds}{\partial Vgs}_{for\ common\ used\ ECM\ with\ Vgs=0\ and\ Vdd<|Vp|}=-0.25\frac{Vdd}{Vp} \quad \text{Eq. 51}$$

It is appreciated that the microphone circuits described above, and particularly the microphone circuits shown and described with reference to FIGS. 18 and 20, include a sample-and-hold circuit (e.g., circuits 89). The sample-and-hold circuit may additionally controls the supply of the operating voltage to microphone buffer circuit (e.g., ECM circuit 88) and/or buffer transistor (e.g., FET 44), a current source and a power source. The operation of the sample-and-hold circuit may be synchronized with operation of circuit controlling the supply of operating voltage to buffer transistor (e.g., FET 44), and/or the current source and and/or the voltage source. It is appreciated that the microphone circuit may additionally include a voltage follower circuit (e.g., circuit 107) providing bias voltage to the sample-and-hold capacitor.

Figure 23:
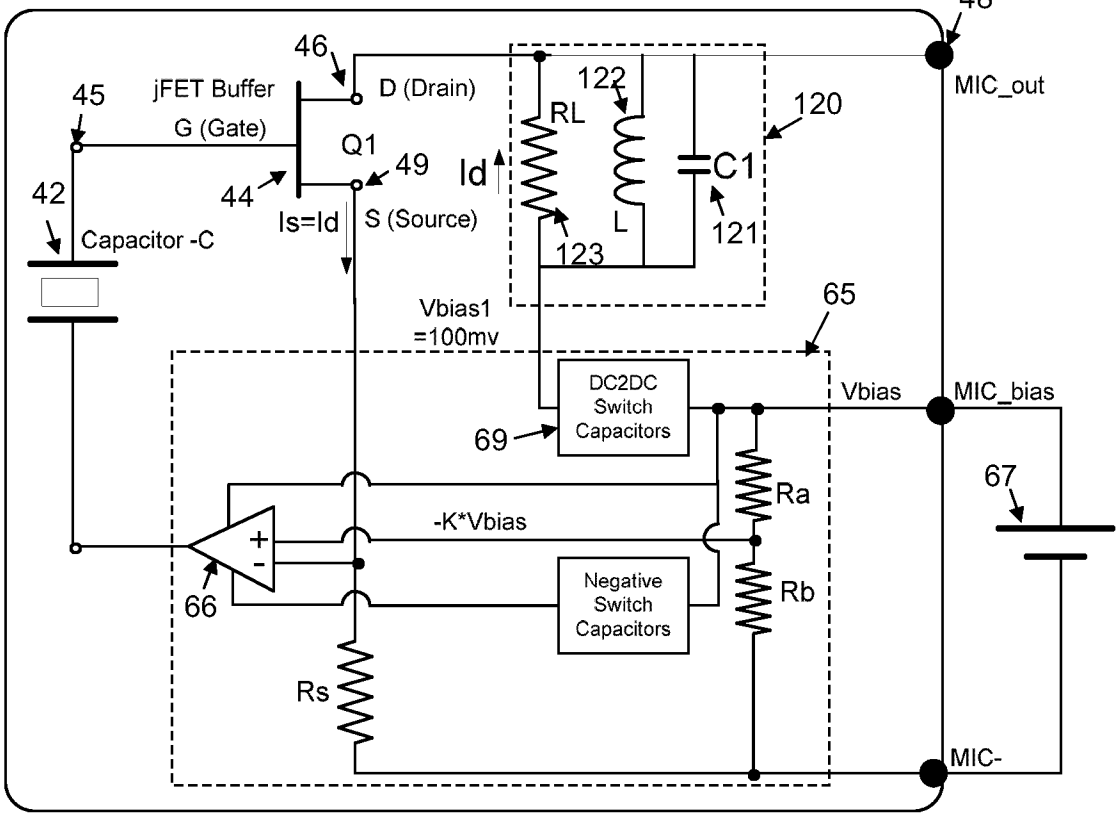
FIG. 23 is a simplified schematic diagram of a resonator ECM circuit.

Reference is now made to FIG. 23, which is a simplified schematic diagram of a resonator ECM circuit 119, according to one possible embodiment. As an option, resonator ECM circuit 119 may be viewed in the context of the details of the previous Figures. Of course, however, resonator ECM circuit 119 may be viewed in the context of any desired environment. Further, the aforementioned definitions may equally apply to the description below.

As shown in FIG. 23, the resonator ECM circuit 119 is similar to the ultra-low power ECM electrical circuitry 64 of FIG. 12 replacing the load network 47 of the ultra-low power ECM electrical circuitry 64 of FIG. 12 with a resonator circuit 120 of FIG. 23. It is appreciated that other modifications and additions, such as the use of other electrical circuits described herein, are also contemplated. As shown in FIG. 23, resonator circuit 120 may include a capacitor 121, a choke or inductor 122, and a resistor 123, for example, connected in parallel.

In DC mode inductor L connects Vbias1 to the jFET. Therefore equation 30 becomes $V_{dd}=V_{dd}$ and for small signals equation 29 becomes equation 52:

$$I_d=I_{dss}\left[2\left(1-\frac{Vgs}{Vp}\right)\left(\frac{Vds}{-Vp}\right)-\left(\frac{Vds}{Vp}\right)^2\right] \quad \text{Eq. 52}$$

Or equation 53:

$$I_d=K_1\lfloor 2(Vp-Vgs)Vds+Vds^2\rfloor \text{ were } K_1=\frac{I_{dss}}{Vp^2} \quad \text{Eq. 53}$$

$$\frac{\partial I_d}{\partial Vgs}=-2K_1Vds+2K_1(Vp-Vgs)\frac{\partial Vds}{\partial Vgs}+2K_1Vds\frac{\partial Vds}{\partial Vgs} \quad \text{Eq. 54}$$

Considering that $$\frac{\partial Vds}{\partial Vgs}=\text{Gain and } -\frac{R\partial I_d}{\partial Vgs}=\text{Gain,}$$

the gain is given by equation 55:

$$-\frac{\partial Vds}{\partial Vgs}=-2KV_{dd}+2K(Vp-Vgs)\frac{\partial Vds}{\partial Vgs}+2KV_{dd}\frac{\partial Vds}{\partial Vgs} \quad \text{Eq. 55}$$

$$\text{where } K=-\frac{RI_{dss}}{Vp^2}$$

Therefore the function Ψ(K) is given by equation 56:

$$\psi(K)=\frac{\partial Vds}{\partial Vgs}=\frac{2KV_{dd}}{1+2K(Vp-Vgs)+2KV_{dd}} \quad \text{Eq. 56}$$

Which is typically is a monotonic function, which can be approximated as follows:

$$\frac{\partial Vds}{\partial Vgs}=\begin{cases}2KV_{dd}=\frac{=2RI_{dss}}{Vp}\left(\frac{Vdd}{Vp}\right) & \text{for Lower } K's\\ 2KV_{dd}=\frac{=2RI_{dss}}{Vp}\left(\frac{Vdd}{Vp}\right) & \text{for } Vdd=Vgs-Vp\\ \frac{V_{dd}}{Vp-Vgs} & \text{for lower } Vdd \text{ and high } K \text{ values}\end{cases} \quad \text{Eq. 57}$$

Therefore, for Vdd=Vgs−Vp, the gain is $$2KV_{dd}=\frac{=2RI_{dss}}{Vp}\left(\frac{Vdd}{Vp}\right).$$

This may be compared with equation 39, where the gain is fixed at −0.4142. It is appreciated that using the resonator ECM circuit 119 and by selecting appropriate resistance for the resonator circuit 120, a higher gain value can be achieved, further selecting jFET with a higher Idss, to compensate for the SNR.

A lower Vdd gives $$\frac{V_{dd}}{Vp - Vgs} = \frac{V_{dd}}{Vp}\frac{1}{\left(1 - \frac{Vgs}{Vp}\right)},$$

which, compared with equation 51 produces a higher gain due to the $$\frac{1}{\left(1 - \frac{Vgs}{Vp}\right)}.$$

This mode of operation as demonstrated by the resonator ECM circuit 119 is useful when working in the ohmic region, with the microphone used as a receiver of an ultra-low power sensor. Applying Vdd directly through the inductor, increases the gain that may be achieved.

It is appreciated that the only sources for power consumption is the current of 5 μA drawn from 1.5/16 V. This means that the consumption from the 1.5V power supply may be 5/16=0.3125 μA. The Vbias1 and the negative voltage supply may consume nearly no power. Thus, the only other power consumers are operational amplifier consuming a current of 50 nA, and the 32 kHz oscillator consuming a current of 0.15-0.2 μA. Therefore the ECM circuitry may be working on a full span (20 Hz to 20 kHz) with a current consumption of about 0.5 μA.

It is appreciated that the methods, systems and electrical circuits described above with reference to electret condenser microphones may also apply, with necessary modifications, to other types of condenser or capacitive microphones such as MEMS microphones. When sound waves hit the MEMS capacitor membrane in changes the capacitance of the MEMS microphone.

Therefore, a MEMS microphone may be used, with necessary modification, using any of the electrical circuits shown and described with reference to FIG. 11, FIG. 12, FIG. 18, FIG. 20, and/or FIG. 23, and combinations thereof.

Figure 24:
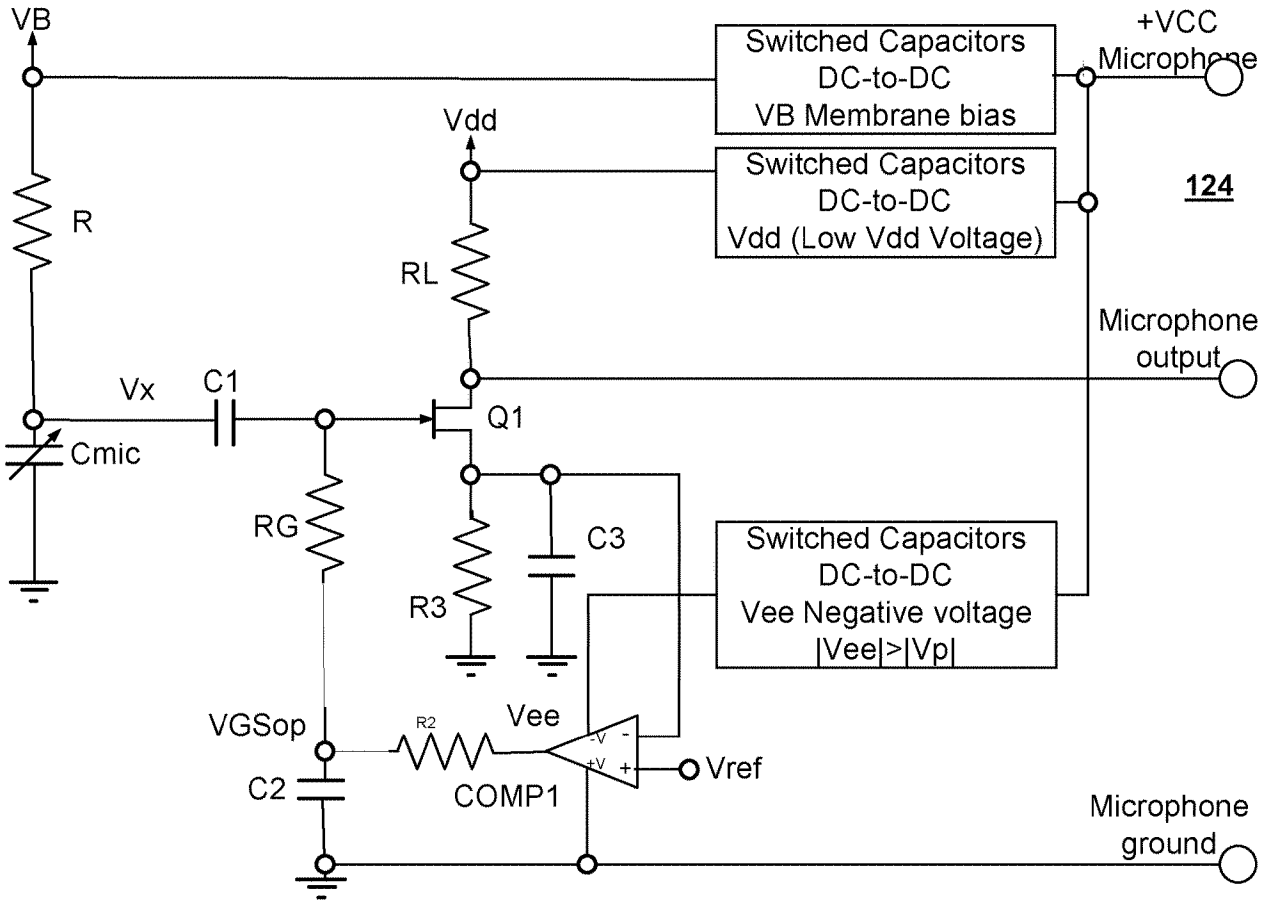
FIG. 24 is a simplified block diagram of a MEMS microphone circuit.

Reference is now made to FIG. 24, which is a simplified block diagram of a MEMS microphone circuit 124, according to one possible embodiment. As an option, MEMS microphone circuit 124 may be viewed in the context of the details of the previous figures. Of course, however, MEMS microphone circuit 124 may be viewed in the context of any desired environment. Further, the aforementioned definitions may equally apply to the description below.

Assuming that the MEMS sensor (microphone) has capacitance of Cmic, which is charged with some electric charge so that the voltage on the Cmic with no acoustic pressure is VB. The MEMS sensor is typically connected to a "pickup" amplifier performing as a buffer to avoid any load on the variable capacitor. The pickup amplifier presents the variation of the voltage on Cmic to the output. Equations 58, 59, 60, and 61 below describe the relation between the change of capacitance of Cmic and the resulting change in voltage over Cmic.

$$Q = V * C \text{ then} \quad \text{Eq. 58}$$

$$Q = V_B C_{mic} \Rightarrow V_{cap} = V_x = \frac{Q}{C_{mic}}, \text{ therefore} \quad \text{Eq. 59}$$

-continued $$\frac{\partial V_x}{\partial C_{mix}} = -\frac{Q}{C_{mix}^{w}} = -\frac{V_B C_{mic}}{C_{mic}^2} = -\frac{V_B}{C_{mic}}, \text{ thus} \quad \text{Eq. 60}$$

$$\Delta V_x = \left(-\frac{V_B}{C_{mic}}\right)\Delta C_{mic} \quad \text{Eq. 61}$$

Therefore a larger $V_B$ may cause a large signal output. $V_B$ is limited to eliminate damage to the MEMS sensor due to voltage breakdown. The capacitor thickness is a few micrometers and the breakdown voltage in air is 3 MV/m, which means that for a gap of 5 μm-10 μm the maximum bias voltage is 15 v-30 v. $V_B$ is also limited to eliminate diffraction of the membrane due to of electric forces, which may cause distortion.

As shown in FIG. 24, FET transistor Q1 works with a very low Vdd, as it is biased to work with low current. It is appreciated that Q1 is FET transistor with a high IDSS value, big width parameter (W) and small length parameter (L)). Therefore VGSop is close to Vp and hence for Q1 to work in saturation, Vds>VGSop−Vp. Thus, Vdd is quite as low as few mV.

The resistor R3 is used with operational amplifier COMP1 to set VR3=Vref and hence to set Id=Vref/R3. Operational amplifier COMP1 output is filtered by a network including a resistor R2 and a capacitor C2. The output voltage VGSop of the operational amplifier COMP1 is connected to the gate of Q1 via large Resistor RG. Capacitor C1 is a coupling capacitor. Considering the values of resistor RG and the capacitance of FET Q1, Capacitor C1 may not load Cmic.

Figure 25:
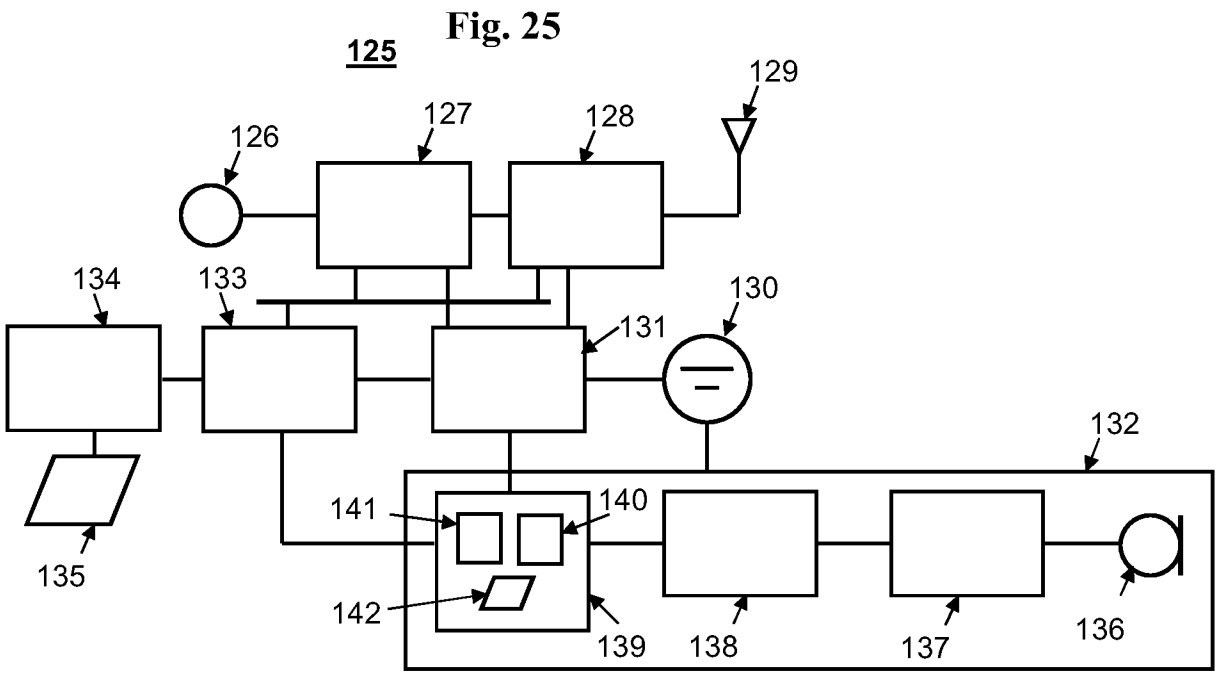
FIG. 25 is a simplified block diagram of a wireless sensor device.

Reference is now made to FIG. 25, which is a simplified block diagram of a wireless sensor device 125, according to one possible embodiment. As an option, wireless sensor device 125 may be viewed in the context of the details of the previous Figures. Of course, however, wireless sensor device 125 may be viewed in the context of any desired environment. Further, the aforementioned definitions may equally apply to the description below.

As shown in FIG. 25, wireless sensor device 125 may include a sensor 126 connected to a sensor circuit 127, which is connected to a wireless circuit 128, connected to an antenna 129. A power source 130 connected to an energy management circuit 131, which may be connected to both the sensor circuit 127, and the wireless circuit 128. The power source 130 is also connected to an acoustic trigger circuit 132, which is connected to the energy management circuit 131. Optionally, the wireless sensor device 125 may also include a processor 133 connected to a memory device 134, and a software program 135. The software program 135 may be stored in the memory device 134 and executed by the processor 133. The processor 133 may be connected to and controlling the sensor circuit 127, the wireless circuit 128, and the energy management circuit 131

The acoustic trigger circuit 132 may include an acoustic sensor 136 connected to an acoustic sensor buffer circuit 137, which is connected to an optional filter array 138, which is connected to a decision circuit 139, which is connected to the energy management circuit 131. Optionally, the decision circuit 139 may include a processor 140, a memory device 141, and a software program 142, typically stored in the memory device 141 and executed by the processor 140. Optionally, the acoustic trigger circuit 132 is connected to the processor 133.

The sensor 126 may be, for example, a temperature sensor. The power source 130 may be, for example, a coin battery such as CR2032. The acoustic sensor 136 may be a microphone, such as an electret condenser microphone (ECM). The sensor buffer circuit 137 may be any of the circuits described above and combinations thereof. For example, sensor buffer circuit 137 may be based on the resonator ECM circuit 119 of FIG. 23. The wireless circuit 128 may use any type of wireless communication technology, including, but not limited to, Bluetooth, Zigbee, Wi-Fi, etc. The wireless circuit 128 may by a transmitter or a transceiver.

Sensor buffer circuit 137 may use an ultra-low power microphone consuming about 0.5 μA as described above. The output of sensor buffer circuit 137 may be provided to filter array 138, which may include one or more mixers. The output of filter array 138 may be provided to decision circuit 139. When a particular acoustic signal (marker, beacon) is received, an ON/OFF signal is generated decision circuit 139 and provided to energy management circuit 131. Thereafter energy management circuit 131 wakes up the sensor circuit 127, and the wireless circuit 128.

The wireless sensor device 125 may then execute required operations such as on/off, signal detection, and data transmission. An appropriate acoustic signal detected by the decision circuit may be based on receiving at least one audio tone (single frequency), or a combination of frequencies coming through the filter array, or any kind of acoustic modulated data like spread spectrum, etc.

Once an acoustic signal is detected by the decision circuit 139, an On/Off trigger may be generated by the decision circuit 139 and provided to energy management circuit 131 or any other part of the wireless sensor device 125. For example, the On/Off trigger may be a hardware trigger provided to a CPU (e.g., processor 133), turning on the CPU, which then may turn on the wireless circuit 128.

Therefore, wireless circuit 128, and/or sensor circuit 127, and/or the entire circuit, may be kept on sleep or OFF mode, and wake up only when an appropriate acoustic signal marker is detected and an interrupt is generated by the decision circuit 139. The acoustic marker may turn ON power, or generate an interrupt for an internal CPU in the sensor, which can then turn ON and operate an internal Bluetooth transceiver. This method will allow the RF transceiver to consume less power in standby mode, therefore operating for a much longer period using the same battery.

For example, a medical Bluetooth RF sensor that is programmed to send stored data such as heartbeat rate, responsive to a request from a smartphone. One possible solution is that the RF unit of the medical sensor wakes up periodically, typically several times each second, to check for a request from the smartphone. These wake-ups consume a considerable amount of battery power. An RF sensor as the medical RF sensor described above is typically required to operate for at least one year using a coin cell battery.

Using the electrical circuits described above, the RF transceiver may be in sleep mode for most of the time, without the need to periodically wake up, until a wake up trigger, or interrupt, is generated based on external acoustic signal. The power consumption of the acoustic receiver trigger circuit such as described above consumes much less power than of the RF receiver. Therefore, only the acoustic receiver wakes up periodically. Once the smartphone needs to receive data from the Bluetooth sensor, the smartphone generates an audio signal using it's built in speakers. The audio signal is received by the acoustic receiver, which generates an interrupt to the CPU to turn ON the Bluetooth transceiver. The Bluetooth transceiver will then be ready to communicate data with the smartphone.

Figure 26:
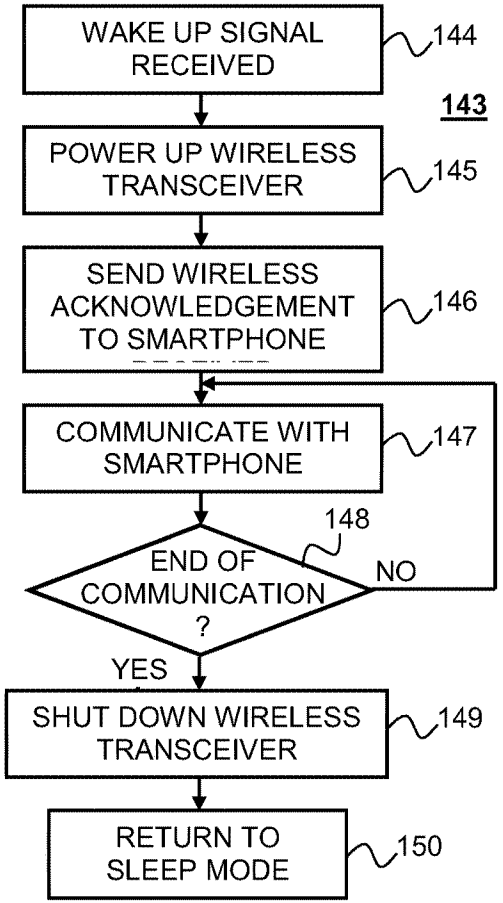
FIG. 26 is a simplified flow chart of a software program for wireless sensor device.

Reference is now made to FIG. 26, which is a simplified flow chart of a software program 143 for wireless sensor device 125, according to one possible embodiment. As an option, software program 143 may be viewed in the context of the details of the previous Figures. Of course, however, software program 143 may be viewed in the context of any desired environment. Further, the aforementioned definitions may equally apply to the description below.

Software program 143 may part of a wireless sensor device such as wireless sensor device 125 of FIG. 25. Software program 143 may be stored in a memory device of the wireless sensor device such as memory 134 and may be executed by a processor of the wireless sensor device such as processor 133 of FIG. 25.

As shown in FIG. 26, software program 143 may start with step 144 by receiving a wake up signal, for example, from acoustic trigger circuit 132 of FIG. 25. It is appreciated until receiving the wake up signal the wireless sensor device is in sleep mode.

Software program 143 may then proceed to step 145 to power up (wake up) a wireless transceiver, such as wireless circuit 128 of FIG. 25, which may be, for example, a Bluetooth transceiver. It is appreciated that the wireless transceiver may use any type of communication technology including, but not limited to, any type of wireless personal area network device (WPAN). Software program 143 may then proceed to step 146 to send to the smartphone an acknowledgement signal.

Software program 143 may then proceed to steps 147 and 148 to communicate with the smartphone (or a similar device). When the communication ends (step 148), software program 143 may then proceed to step 149 to shut down the wireless transceiver, and then to step 150 to return (the wireless sensor device) to sleep mode.

It is appreciated that software program 143 may be executed in a firmware of a CPU of the wireless sensor device, and that it is an example of an algorithm that can be executed in a battery operated medical wireless sensor, which is placed on a human body and collects data. Software program 143 may work with a mixed acoustic-RF wireless sensor as shown and described with reference to FIG. 25. The wireless sensor's CPU can be put to sleep mode, until an interrupt is received from acoustic trigger circuit 132. The interrupt is generated using an ultra-low power microphone sensor hardware using any of the electrical circuits shown and described above. The acoustic hardware trigger may generate a wakeup interrupt to the CPU. The CPU may then turn ON the Bluetooth transceiver to communicate with the smartphone or a similar device.

Figure 27:
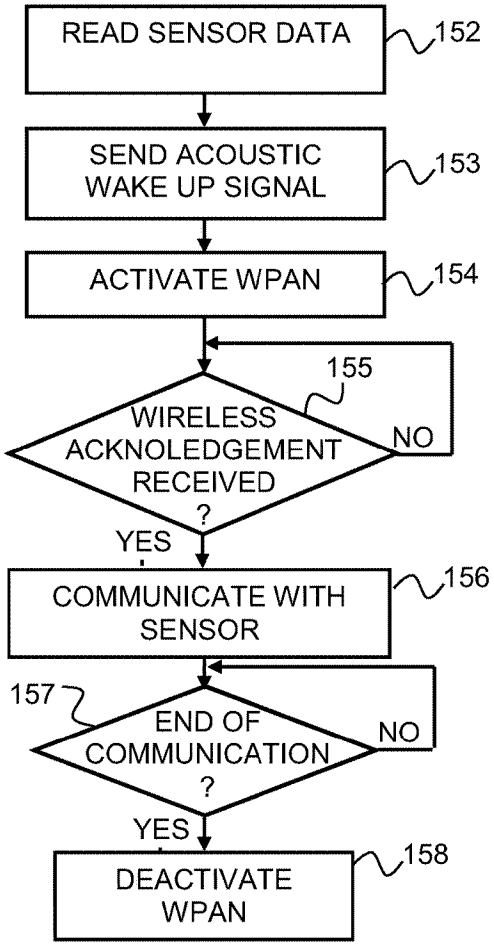
FIG. 27 is a simplified flow chart of a software program for wireless terminal device such as a smartphone.

Reference is now made to FIG. 27, which is a simplified flow chart of a software program 151 for wireless terminal device such as a smartphone, according to one possible embodiment. As an option, software program 151 may be viewed in the context of the details of the previous Figures. Of course, however, software program 151 may be viewed in the context of any desired environment. Further, the aforementioned definitions may equally apply to the description below.

As an example, the wireless terminal is communicating with a sensor device is using a low power Bluetooth transceiver. It is appreciated that the terminal device and the sensor may use any type of communication technology, or RF transceiver, such as Bluetooth, Zigbee, Wi-Fi, etc. The software program 151 may be executed by a processor of the Smartphone and/or in the memory of the smartphone (or any other type of terminal device).

An example of a mixed acoustic-RF sensor, would be a battery powered wireless medical sensor used to measure and send a human heartbeat rate. The sensor may be positioned in or on the human body, communicating with a smartphone, or another wireless terminal device. Once the sensor detects a particular acoustic signal it may turn on and communicate with the smartphone using Bluetooth protocol or a similar communication technology.

As shown in FIG. 27, software program 151 may start with step 152 when it is invoked by a user (manually) or automatically (periodically) to collect data from the sensor device. Software program 151 may then proceed to step 153 to send an acoustic signal to the sensor device. The acoustic signal may be a single-frequency acoustic signal (e.g., 15 kHz), a modulated acoustic signal, a combination of frequencies (e.g., a 15 kHz plus a 16 kHz tones), a DTMF code, a spread spectrum modulated data etc. The software program 151 may generate the acoustic signal using the smartphone's speakers. Software program 151 may then proceed to step 154 to activate the WPAN device of the smartphone (e.g. Bluetooth, or a similar WPAN technology).

After an acknowledgement signal is received (step 155) Software program 151 may proceed to step 156 to communicate with the sensor device and collect data as required. After the communication phase ends (step 157) Software program 151 may proceed to step 158 to deactivate the WPAN device.

It is appreciated that particular sensors may use particular combinations of acoustic tones as wake up signals. For example, the acoustic signal can represent some of the digits in the serial number of the sensor. In this method, generating a proper acoustic signal would turn ON only the specific sensor, and not all the sensors. Acoustic tones may use various frequencies, for various times, and also use various amplitudes, in order to generate unique audio codes.

Figure 28:
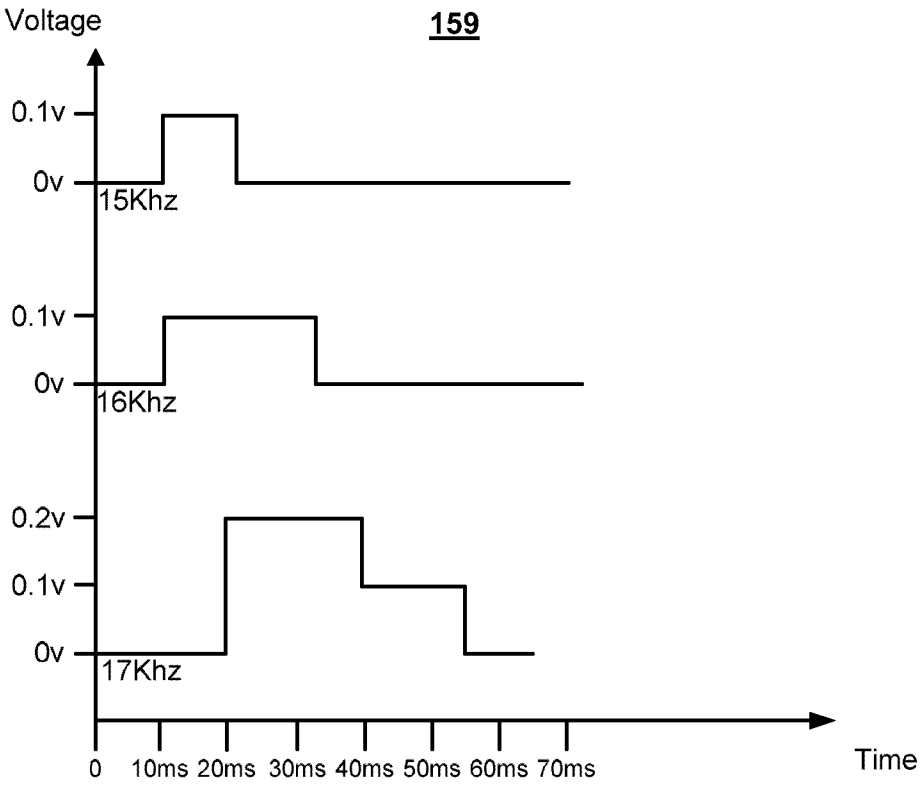
FIG. 28 is a simplified time diagram of a three-tone acoustic signal.
Figure 29:
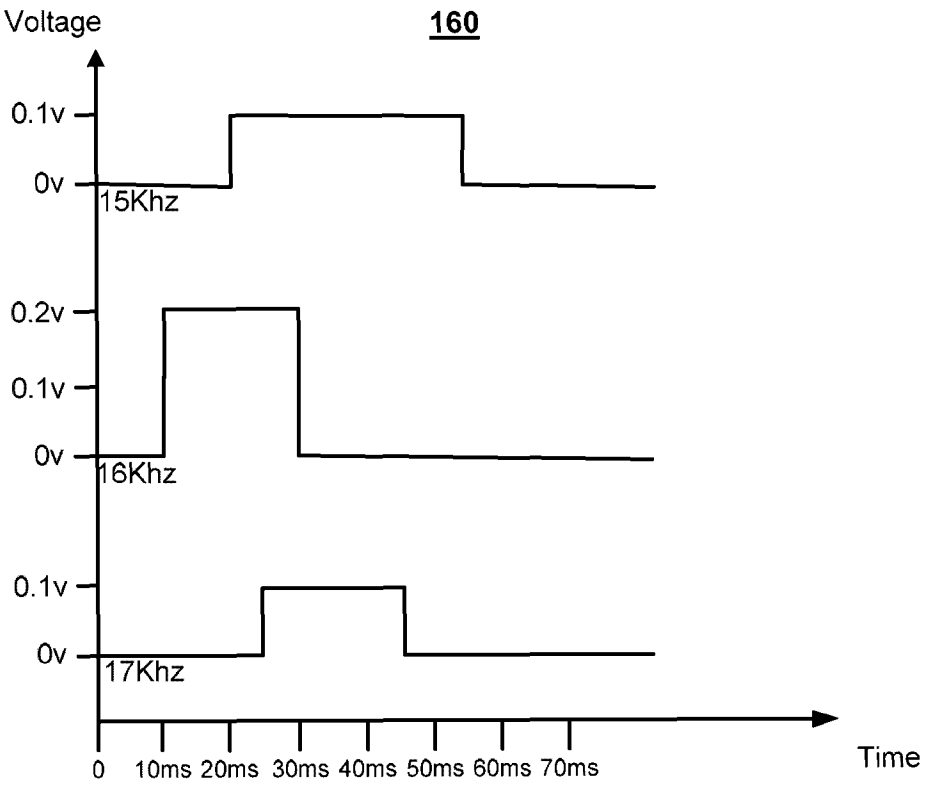
FIG. 29 is a simplified time diagram of another three-tone acoustic signal.

Reference is now made to FIG. 28 and FIG. 29, which are simplified time diagrams of two three-tone acoustic signals 159 and 160, according to one possible embodiment. As an option, the three-tone acoustic signals 159 and 160 may be viewed in the context of the details of the previous Figures. Of course, however, the three-tone acoustic signals 159 and 160 may be viewed in the context of any desired environment. Further, the aforementioned definitions may equally apply to the description below.

The three-tone acoustic signals 159 and 160 are examples of an acoustic trigger for waking up a particular sensor. The acoustic trigger uses a three tone combination to create the sensor's ID. In this example, the three tones are: a 15 kHz tone, a 16 kHz tone, and a 17 kHz tone. The three tones are generated according to a particular pattern of time and amplitude as shown in FIGS. 28 and 29. The three-tone acoustic signals 159 and 160 may then be detected by a filter array, such as filter array 138 of FIG. 25, and then processed by the decision circuit 139.

For example, the three tones of FIG. 28 represent the sensor's ID number 28948, while the three tones of FIG. 29 represent the sensor's ID number 32564.

Figure 30:
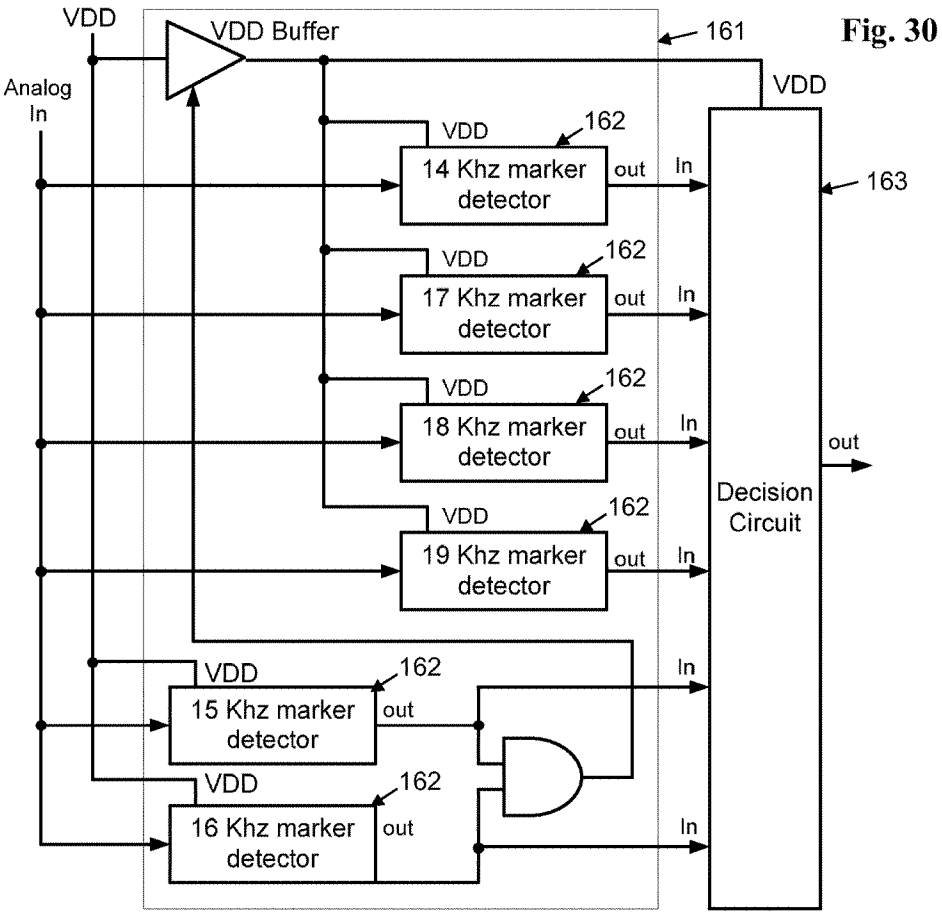
FIG. 30 is a simplified block diagram of a filter array.

Reference is now made to FIG. 30, which is a simplified block diagram of a filter array 161, according to one possible embodiment. As an option, the filter array 161 may be viewed in the context of the details of the previous Figures. Of course, however, the filter array 161 may be viewed in the context of any desired environment. Further, the aforementioned definitions may equally apply to the description below.

As seen in FIG. 30, the filter array 161 may have several acoustic frequency detectors 162. Acoustic frequency detectors 162 may provide a decision circuit 163 information enabling it to decide, for example, whether to turn ON an RF system. As seen in FIG. 30, there can be a plurality of acoustic frequency detectors 162 enabling the detection of a plurality of acoustic signals, for example, where each acoustic signal identifies a different command or a different device, such as the sensor IDs of FIGS. 28 and 29.

To further reduce power consumption, the filter array 161 may have a first stage of operation where only some of the acoustic frequency detectors 162 may be operative and the rest may be turned off. For example, in FIG. 30, two frequency detector (in this example, the 15, 16 kHz detectors) are ON and the rest are shut down. When a marker signal is detected by both 15 kHz and 16 kHz frequency detectors the VDD buffer provides operating voltage to the other acoustic frequency detectors 162 and the filter operates in a second, fully operational, stage, In such case, an initial marker transmission combined from two frequencies (15 and 16 kHz) turns ON the rest of the acoustic frequency detectors 162 and the decision circuit 163 and enabling detection of a larger plurality of acoustic signals. Therefore reducing power consumption during stand by period.

It is appreciated that many different combinations of this circuit are contemplated to enable a large variety of acoustic markers and/or commands. For example, by providing more than two stages of operation, where different stages use different combinations of acoustic frequency detectors 162, and/or where some stages use a larger number of acoustic frequency detectors 162.

As discussed above with reference to FIGS. 28 and 29, the acoustic frequency detectors 162 may detect amplitude, phase, duration and other aspects of the input marker transmission input, to provide a larger range of commands, data, sensor ID, etc. It is appreciated that a signal having higher complexity may reduce errors such as caused by noise, which may further reduce power consumption of the entire trigger circuit.

It is appreciated that the microphone circuits described above may include a radio unit including a radio receiver, a radio transmitter, and/or a radio transceiver. The microphone circuit may be operative to wake-up the radio unit form sleep mode upon detecting a predefined acoustic signal. The microphone circuit may additionally include a filter array to detect one or more acoustic tones and/or frequencies. Any of the acoustic tones may be modulated. The modulation may include a different starting time, a different ending time, and a different amplitude.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A device comprising:

a buffer transistor, which gate terminal is connected to a first terminal of a capacitive acoustic sensor, which drain terminal is connected via a load network to a power source and to an output terminal, and which source terminal is connected to at least one of:

a regulated current source;

wherein said regulated current source is connected between said source terminal of said buffer transistor and a reference terminal; and wherein said reference terminal being connectable to a second terminal of said capacitive acoustic sensor; and via a resistor to a reference terminal, and a regulated voltage source is connected between a second terminal of said acoustic sensor and said reference terminal, wherein said regulated voltage source provides at least one of:

a negative voltage at said gate terminal of said buffer transistor relative to said source terminal of said buffer transistor if said buffer transistor has an N-channel; and a positive voltage at said gate terminal of said buffer transistor relative to said source terminal of said buffer transistor if said buffer transistor has an P-channel, and wherein said buffer transistor has a relatively high drain current at zero bias (Idss).

2. The device according to claim 1, wherein said power source comprises a comparator device for determining operating point of said buffer transistor.

3. The device according to claim 1 wherein said buffer transistor is at least one of: a field effect transistor (FET), a jFET and a MOSFET.

4. The device according to claim 1 wherein said buffer transistor is selected according to at least one of: a minimum Length L, a maximum Width W, a large current through the device, and a minimum input capacitance.

5. The device according to claim 1 wherein said buffer transistor is operative in at least one of: saturation region and ohmic region.

6. A device comprising:

a buffer transistor, which gate terminal is connected to a first terminal of a capacitive acoustic sensor, which drain terminal is connected via a load network to a power source and to an output terminal, and which source terminal is connected to at least one of:

a regulated current source;

wherein said regulated current source is connected between said source terminal of said buffer transistor and a reference terminal; and wherein said reference terminal being connectable to a second terminal of said capacitive acoustic sensor; and via a resistor to a reference terminal, and a regulated voltage source is connected between a second terminal of said acoustic sensor and said reference terminal; and a sample-and-hold circuit, wherein said sample-and-hold circuit is additionally operative to control supply of operating voltage to at least one of said buffer transistor, said current source and said power source, and wherein operation of said sample-and-hold circuit is synchronized with operation of said supply of operating voltage to at least one of said buffer transistor, said current source and said power source.

7. A method comprising:

connecting a gate terminal of a buffer transistor to a first terminal of a capacitive acoustic sensor;

connecting a drain terminal of said buffer transistor via a load network to a power source and to an output terminal; and connecting a source terminal of said buffer transistor to at least one of:

a regulated current source connected between said source terminal of said buffer transistor and a reference terminal; and to a reference terminal via a resistor, and connecting a regulated voltage source between a second terminal of said capacitive acoustic sensor and said reference terminal, wherein said regulated voltage source provides at least one of:

a negative voltage at said gate terminal of said buffer transistor relative to said source terminal of said buffer transistor if said buffer transistor has an N-channel; and a positive voltage at said gate terminal of said buffer transistor relative to said source terminal of said buffer transistor if said buffer transistor has an P-channel, wherein said reference terminal is connectable to a second terminal of said capacitive acoustic sensor, and wherein said buffer transistor has a relatively high drain current at zero bias (Idss).

8. The method according to claim 7, wherein said power source comprises a comparator device for determining operating point of said buffer transistor.

9. The method according to 7 wherein said buffer transistor is at least one of: a field effect transistor (FET), a jFET and a MOSFET.

10. The method according to claim 7 wherein said buffer transistor is selected according to at least one of: a minimum Length L, a maximum Width W, a large current through the device, and a minimum input capacitance.

11. The method according to claim 7, wherein said buffer transistor is operative in at least one of: saturation region and ohmic region.

12. A method comprising:

connecting a gate terminal of a buffer transistor to a first terminal of a capacitive acoustic sensor;

connecting a drain terminal of said buffer transistor via a load network to a power source and to an output terminal; and connecting a source terminal of said buffer transistor to at least one of:

a regulated current source connected between said source terminal of said buffer transistor and a reference terminal; and to a reference terminal via a resistor, and connecting a regulated voltage source between a second terminal of said capacitive acoustic sensor and said reference terminal;

wherein said reference terminal being connectable to a second terminal of said capacitive acoustic sensor; and connecting a sample-and-hold circuit to said drain terminal of said buffer transistor;

wherein said sample-and-hold circuit is additionally operative to control supply of operating voltage to at least one of said buffer transistor, said current source and said power source, and wherein operation of said sample-and-hold circuit is synchronized with operation of said supply of operating voltage to at least one of said buffer transistor, said current source and said power source.

13. The device according to claim 6 wherein said regulated current source forces a relatively low drain-source current via said buffer transistor.

14. The device according to claim 6, wherein said current source is based on a current mirror circuit.

15. The device according to claim 6, wherein said current source comprises a comparator device to set the bias current of the said buffer to a pre-defined value.

16. The device according to claim 6, wherein said power source comprises a comparator device for determining operating point of said buffer transistor.

17. The device according to claim 6, wherein said buffer transistor is at least one of: a field effect transistor (FET), a jFET and a MOSFET.

18. The device according to claim 6, wherein said buffer transistor is selected according to at least one of: a minimum Length L, a maximum Width W, a large current through the device, and a minimum input capacitance.

19. The device according to claim 6 wherein said buffer transistor is operative in at least one of: saturation region and ohmic region.

20. The method according to claim 12, wherein said regulated current source forces a relatively low drain-source current via said buffer transistor.

21. The method according to claim 12, wherein said current source is based on a current mirror circuit.

22. The method according to claim 12, wherein said current source comprises a comparator device to set the bias current of the said buffer to a pre-defined value.

23. The method according to claim 12, wherein said power source comprises a comparator device for determining operating point of said buffer transistor.

24. The method according to claim 12, wherein said buffer transistor is at least one of: a field effect transistor (FET), a jFET and a MOSFET.

25. The method according to claim 12, wherein said buffer transistor is selected according to at least one of: a minimum Length L, a maximum Width W, a large current through the device, and a minimum input capacitance.

26. The method according to claim 12, wherein said buffer transistor is operative in at least one of: saturation region and ohmic region.

27. The device according to claim 1 wherein said regulated current source forces a relatively low drain-source current via said buffer transistor.

28. The device according to claim 1 wherein said current source is based on a current mirror circuit.

29. The device according to claim 1 wherein said current source comprises a comparator device to set the bias current of the said buffer to a pre-defined value.

30. The method according to claim 7 wherein said regulated current source forces a relatively low drain-source current via said buffer transistor.

31. The method according to claim 7 wherein said current source is based on a current mirror circuit.

32. The method according to claim 7 wherein said current source comprises a comparator device to set the bias current of the said buffer to a pre-defined value.

* * * * *